US010834990B2

(12) United States Patent
Elder et al.

(10) Patent No.: US 10,834,990 B2
(45) Date of Patent: Nov. 17, 2020

(54) FOOT SUPPORT MEMBERS THAT PROVIDE DYNAMICALLY TRANSFORMATIVE PROPERTIES

(71) Applicant: NIKE, Inc., Beaverton, OR (US)

(72) Inventors: Zachary M. Elder, Portland, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 182 days.

(21) Appl. No.: 15/572,245

(22) PCT Filed: May 25, 2016

(86) PCT No.: PCT/US2016/033997

§ 371 (c)(1),
(2) Date: Nov. 7, 2017

(87) PCT Pub. No.: WO2016/191447

PCT Pub. Date: Dec. 1, 2016

(65) Prior Publication Data

US 2018/0125148 A1 May 10, 2018

Related U.S. Application Data

(60) Provisional application No. 62/166,365, filed on May 26, 2015.

(51) Int. Cl.
*A43B 3/00* (2006.01)
*A43B 13/18* (2006.01)
(Continued)

(52) U.S. Cl.
CPC ..... *A43B 3/0057* (2013.01); *A43B 13/122* (2013.01); *A43B 13/125* (2013.01);
(Continued)

(58) Field of Classification Search
CPC ... A43B 3/0057; A43B 13/122; A43B 13/125; A43B 13/141; A43B 13/181; A43B 13/185
(Continued)

(56) References Cited

U.S. PATENT DOCUMENTS 362,923 A 5/1887 Baker
2,627,676 A * 2/1953 Hack ..... A43B 13/184 36/29
(Continued)

FOREIGN PATENT DOCUMENTS

DE 4137350 A1 5/1993
EP 0122985 B1 2/1987
(Continued)

OTHER PUBLICATIONS

Aug. 25, 2016—(WO) International Search Report PCT/US2016/033997.

*Primary Examiner* — Anne M Kozak
(74) *Attorney, Agent, or Firm* — Banner & Witcoff, Ltd.

(57) ABSTRACT

Foot support members, e.g., sole structures for articles of footwear, include dynamically transformable portions, e.g., to change a dimension and/or apply a tensile or compressive force to some portion of an article of footwear or other foot-receiving device. Such foot support members may include a flexible support member having a wave shaped portion that flexes under an applied force. Flexing of this wave shaped portion under weight of a wearer produces: (a) a change in at least one of a longitudinal or transverse dimension of the foot support member, (b) application of a compressive or tensile force to the plantar support component and/or another part of the foot support member, article of footwear, or other foot-receiving device, (c) flattening of the wave shaped portion, and/or (d) compressing the wave
(Continued)

shaped portion together (e.g., to fold up, decrease in overall height, etc.).

20 Claims, 15 Drawing Sheets

(51) Int. Cl.
*A43B 13/12* (2006.01)
*A43B 13/14* (2006.01)

(52) U.S. Cl.
CPC ..... *A43B 13/141* (2013.01); *A43B 13/181* (2013.01); *A43B 13/185* (2013.01)

(58) Field of Classification Search
USPC ..... 36/25 R
See application file for complete search history.

(56) References Cited

U.S. PATENT DOCUMENTS 2,710,461 A * 6/1955 Hack ..... A43B 13/184 36/28
3,719,965 A * 3/1973 Chevallereau ..... A43B 13/04 12/146 B
4,561,195 A 12/1985 Onoda et al.
4,864,737 A 9/1989 Marrello
4,878,300 A 11/1989 Bogaty
5,255,451 A 10/1993 Tong et al.
5,280,680 A 1/1994 Burke et al.
5,337,492 A 8/1994 Anderie et al.
5,528,842 A 6/1996 Ricci et al.
5,572,804 A 11/1996 Skaja et al.
5,598,645 A 2/1997 Kaiser
5,651,196 A 7/1997 Hsieh
5,713,140 A * 2/1998 Baggenstoss ..... A43B 13/223 36/28
5,720,118 A 2/1998 Mayer et al.
5,987,782 A 11/1999 Bramani
6,231,946 B1 5/2001 Brown, Jr. et al.
6,298,582 B1 10/2001 Friton et al.
6,314,664 B1 * 11/2001 Kita ..... A43B 13/12 36/28
6,389,713 B1 5/2002 Kita
6,401,365 B2 6/2002 Kita et al.
6,516,539 B2 2/2003 Nishiwaki et al.
6,557,270 B2 5/2003 Nakano et al.
6,625,905 B2 9/2003 Kita
6,675,500 B1 * 1/2004 Cadamuro ..... A43B 1/0018 36/27
6,711,834 B1 3/2004 Kita
6,964,119 B2 11/2005 Weaver, III
7,013,581 B2 3/2006 Greene et al.
7,055,198 B2 6/2006 Cadamuro et al.
7,111,415 B2 9/2006 Hockerson
7,162,815 B2 1/2007 Miyauchi et al.
7,383,647 B2 6/2008 Chan et al.
7,421,805 B2 9/2008 Geer
D616,188 S * 5/2010 Chan ..... D2/957
7,937,854 B2 5/2011 Kilgore
7,950,167 B2 5/2011 Nakano
7,954,259 B2 * 6/2011 Antonelli ..... A43B 1/0009 36/25 R
7,987,618 B2 8/2011 Nishiwaki et al.
8,056,261 B2 11/2011 Nakano et al.
8,146,270 B2 * 4/2012 Aveni ..... A43B 13/181 36/27
D659,958 S 5/2012 Birkinhead
D659,965 S * 5/2012 Callahan ..... D2/953
8,181,365 B2 * 5/2012 Cass ..... A43B 13/181 36/103
D691,787 S * 10/2013 Callahan ..... D2/947
8,621,767 B2 1/2014 Vestuti et al.
D713,134 S * 9/2014 Hardigan ..... D2/951
D722,426 S * 2/2015 Davis ..... D2/947
9,015,962 B2 * 4/2015 Boudreau ..... A43B 13/141 36/25 R
9,578,920 B2 2/2017 Grott et al.
9,629,414 B2 * 4/2017 Elder ..... A43B 13/14
9,750,300 B2 9/2017 Peyton et al.
9,930,927 B2 4/2018 Luedecke et al.
9,968,160 B2 5/2018 Peyton
10,251,445 B2 4/2019 McDonald
2005/0000115 A1 1/2005 Kimura et al.
2009/0139114 A1 6/2009 Malek
2009/0145004 A1 6/2009 Jones
2009/0241373 A1 10/2009 Kita et al.
2011/0113656 A1 5/2011 Sato
2011/0239489 A1 10/2011 Iuchi et al.
2012/0167416 A1 * 7/2012 Christensen ..... A43B 7/32 36/103
2013/0247425 A1 * 9/2013 Davis ..... A43B 13/02 36/30 R
2014/0026438 A1 1/2014 Cortez et al.
2014/0259746 A1 9/2014 Abshire et al.
2015/0013185 A1 1/2015 Elder et al.
2015/0089834 A1 4/2015 Baum et al.
2018/0125148 A1 5/2018 Elder et al.
2018/0338568 A1 * 11/2018 Chambers ..... A43B 13/186

FOREIGN PATENT DOCUMENTS

EP 0 857 434 A1 8/1998
EP 0 958 752 A1 11/1999
EP 1 219 193 A1 7/2002
EP 2277402 A2 1/2011
FR 2774566 B1 5/2000
JP 2003339405 A 12/2003
JP 2011010946 A 1/2011
KR 101483775 B1 1/2015
WO 9935928 A1 7/1999
WO 03039283 A1 5/2003
WO 2007069069 6/2007

* cited by examiner

FOOT SUPPORT MEMBERS THAT PROVIDE DYNAMICALLY TRANSFORMATIVE PROPERTIES

CROSS-REFERENCE TO RELATED APPLICATION

This application is a U.S. National Stage application under 35 U.S.C. § 371 of International Application PCT/US2016/033997, filed May 25, 2016 , which claims priority to U.S. Provisional Patent Application No. 62/166,365, titled "Foot Support Members that Provide Dynamically Transformative Properties" and filed May 26, 2015. These applications in their entirety, are incorporated by reference herein.

FIELD

The technology described in this application relates to the field of footwear and other foot-receiving devices. More specifically, aspects of the present disclosure pertain to foot support members (e.g., footwear sole structures) that dynamically transform footwear dimensions and/or other properties under weight of a wearer. Additional aspects of this disclosure relate to articles of footwear (e.g., athletic footwear) or other devices that include such foot support members.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure may provide traction and control potentially harmful foot motion, such as over pronation. The general features and configurations of the upper and the sole structure are discussed in greater detail below.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture and provide a soft, comfortable feel. The midsole, which is traditionally attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

The primary element of a conventional midsole is a resilient, polymer foam material, such as polyurethane foam or ethylvinylacetate ("EVA") foam, that extends throughout the length of the footwear. The properties of the polymer foam material in the midsole are primarily dependent upon factors that include the dimensional configuration of the midsole and the specific characteristics of the material selected for the polymer foam, including the density and/or hardness of the polymer foam material.

BRIEF DESCRIPTION OF THE DRAWINGS

The foregoing Summary, as well as the following Detailed Description, will be better understood when considered in conjunction with the accompanying drawings, which include.

DETAILED DESCRIPTION

Figure 1A:
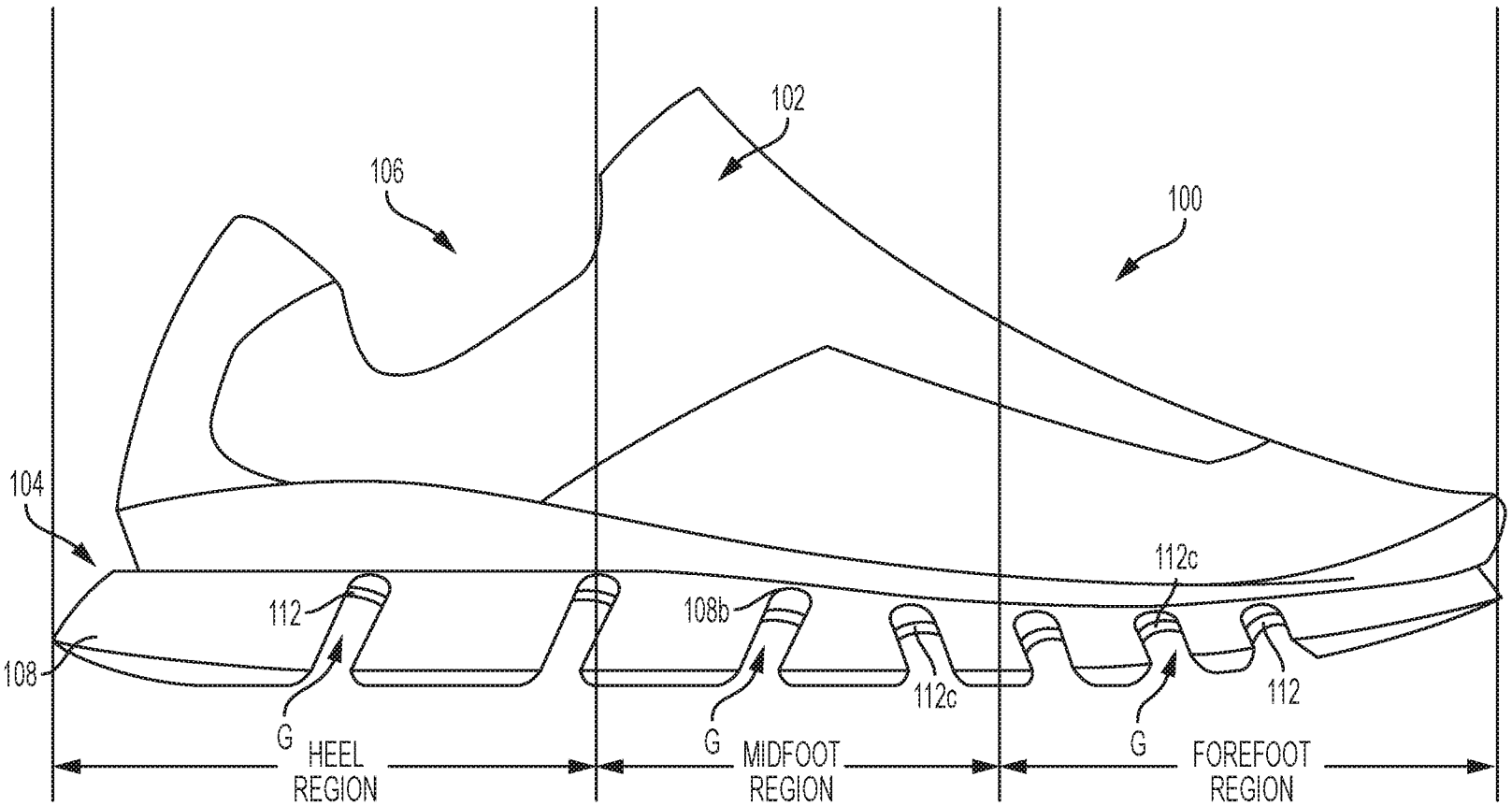
FIG. 1A, which illustrates an example article of footwear that includes a dynamically transformative support component in accordance with some aspects of this disclosure.

In the following description of various examples of foot support components according to the present disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and functions without departing from the scope of the present disclosure.

I. GENERAL DESCRIPTION OF ASPECTS OF THIS DISCLOSURE

Aspects of this disclosure relate to foot support members, articles of footwear (e.g., athletic footwear) and/or other foot-receiving devices that include such foot support members. More specific features and aspects of this disclosure will be described in more detail below.

A. Features of Foot Support Components According to Examples of this Disclosure

Some aspects of this disclosure relate to foot support members, e.g., for articles of footwear and other foot receiving devices. "Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot covering members" (e.g., akin to footwear upper components) and one or more "foot support members" (e.g., akin to footwear sole structure components), including one or more foot support members according to the present disclosure. "Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. Foot support members according to at least some aspects of this disclosure may include components for and/or functioning as midsoles and/or outsoles for articles of footwear.

While potentially useful for any desired types or styles of shoes, aspects of this disclosure may be of particular interest for sole structures used in articles of athletic footwear, including basketball shoes, running shoes, cross-training shoes, cleated shoes, tennis shoes, golf shoes, football shoes, soccer shoes, etc.

More specific aspects of this disclosure relate to foot support members, e.g., portions of sole structures for articles of footwear, that include dynamically transformable portions, e.g., to change a dimension and/or apply a force to some portion of an article of footwear or other foot-receiving device. Such foot support members may include: (a) a plantar support component for supporting at least a portion of a plantar surface of a wearer's foot (and optionally, the entire plantar surface), wherein the plantar support component includes a first surface and a second surface opposite the first surface; and (b) a flexible support member disposed adjacent the second surface of the plantar support component, wherein the flexible support member includes a wave shaped portion. The wave shaped portion may be oriented such that plural wave crests extend toward the first surface of the plantar support component and plural wave troughs extend away from the first surface of the plantar support component. Material of the plantar support component (e.g., polymer foam material) may at least partially fill the interior volume(s) defined by the plural wave troughs. The wave shaped portion may include a rigid plate (e.g., formed of rigid but flexible plastic) capable of flexing under weight of a wearer and returning to its original or substantially original size, shape, and/or dimensions. Flexing of the rigid plate under weight of a wearer may produce one or more of the following reactions: (a) the flexing may change at least one of a longitudinal or transverse dimension of the foot support member, (b) the flexing may apply a compressive force or a tensile force to the plantar support component and/or another part of the foot support member, (c) the flexing may cause at least a portion of the rigid plate to become flatter (e.g., decrease a peak-to-peak amplitude of at least one adjacent wave trough and wave crest pair, increase a wave period for at least one wave crest to an adjacent wave crest, etc.), and/or (d) the flexing may cause at least a portion of the rigid plate to compress together (e.g., fold up, decrease in overall height, decrease wave period, etc.).

The wave shaped portion of the foot support member may have the orientation and/or properties needed to achieve a desired result (e.g., provide impact force attenuation, produce foot support member size modification, produce compressive or tensile forces, etc.). For example, the wave characteristics of the wave shaped portion (such as wave amplitude, wave period, peak-to-peak amplitude, etc.) and/or the rigid plate characteristics (such as thickness, hardness, materials, etc.) may be selected to provide a desired degree of stiffness, flexibility, resiliency, rebound, and/or overall strength. Any one or more of the wave characteristics and/or any one or more of the rigid plate characteristics may vary within a single foot support member structure, e.g., as one moves along the waveform in the wave propagation direction. Alternatively, either or both of the wave characteristics and the rigid plate characteristics may be uniform throughout a single foot support member structure.

In these manners, sole structures of articles of footwear and/or other foot support members in accordance with at least some examples may dynamically (and/or automatically) change their properties based on variations in the load applied to the sole or support member by the foot (e.g., as the user lands a step or jump). The properties and/or sole/support response may vary over the course of movement, e.g., depending on what the wearer is doing. For example, when wearing an article of footwear including a sole structure in accordance with at least some examples of this disclosure, the wearer may feel a relatively soft and comfortable and easy fit, support, and feel when walking. If the user picks up his/her pace (e.g., starts jogging, running, or sprinting) or otherwise becomes involved in more strenuous activities, and these activities result in greater impact forces between the foot and a contact surface, the changes in force simply as a result of landing a step or jump will cause a change or transformation in "feel" for the wearer. As some more specific examples, the sole or support may change in size, become tighter, become stiffer or harder (e.g., more compressed), etc., when exposed to the higher force impacts when the user starts landing steps or jumps. In accordance with at least some aspects of this disclosure, these sole/support changes under different impact forces can occur automatically and substantially instantaneously, without the need for the user to take any independent action to make the changes other than land the step or jump in a normal manner (e.g., no "settings" need to be changed by user interaction with the sole/support; no components need to be inserted, removed, and/or changed in position by user interaction with the sole/support; the shoe/sole need not be removed from the wearer's foot; the user need not touch the sole/support or any external "control device" with his/her hand to change features of the sole/support; the user need not stop and/or alter his/her normal action or activities to change the response or feel of the sole/support; etc.). Similarly, as the user returns to a walking step, the sole/support member will (or can) dynamically (and/or automatically) change its properties back to the lower force response properties and/or "feel" that the user felt during the earlier walking activities.

Additional aspects of this disclosure relate to articles of footwear and other foot-receiving devices that include foot support members of the various types described above. Still additional aspects of this disclosure relate to methods for making foot support members, articles of footwear, and/or other foot-receiving devices that include the various types of foot support structures described above. More specific examples and aspects of this disclosure will be described in detail below.

As some more specific examples, foot support members according to at least some examples of this disclosure may include: (a) a plantar support component for supporting at least a portion of a plantar surface of a wearer's foot (and optionally, the entire plantar surface), wherein the plantar support component includes a first surface and an opposite second surface; and (b) a flexible support member disposed adjacent the second surface of the plantar support component, wherein the flexible support member includes at least one wave shaped portion. The wave shaped portion(s) may be oriented such that plural wave crests extend toward the first surface of the plantar support component and plural wave troughs extend away from the first surface of the plantar support component. In some structures, material of the plantar support component (e.g., polymer foam material) may at least partially fill the interior volume(s) defined by the plural wave troughs. The wave shaped portion may include a rigid plate (e.g., formed of rigid but flexible plastic) capable of flexing under weight of a wearer (and returning to its original or substantially original shape). Flexing of the rigid plate under weight of a wearer may produce one or more of the following reactions: (a) change at least one of a longitudinal or transverse dimension of the foot support member, (b) apply a compressive or tensile force to the plantar support component and/or another part of the foot support member or other structure, (c) cause at least a portion of the rigid plate to become flatter (e.g., decrease a peak-to-peak amplitude of at least one adjacent wave trough and wave crest pair, increase a wave period for at least one wave crest to an adjacent wave crest, etc.), and/or (d) cause at least a portion of the rigid plate to compress together (e.g., fold up, decrease in overall height, shorten the wave period, etc.).

The wave shaped portion of the foot support member may have properties needed to achieve a desired result (e.g., a desired degree of impact force attenuation, a desired degree of foot support member size/shape modification, a desired amount of compressive or tensile force application capability, etc.). As some more specific examples, the wave characteristics of the wave shaped portion (such as wave amplitude, wave period, peak-to-peak amplitude, etc.) and/or the rigid plate characteristics (such as thickness, hardness, materials, shapes, etc. in the wave shaped portion) may be selected to provide a desired degree of stiffness, flexibility, resiliency, rebound, size/shape modification, force application capability, and/or overall strength. Any one or more of the wave characteristics and/or any one or more of the rigid plate characteristics may vary within a single foot support member structure, e.g., as one moves along the wave propagation direction. Alternatively, either or both of the wave characteristics and the rigid plate characteristics may be uniform throughout a single foot support member structure.

The flexible support member may have various size and dimensional features. As some more specific examples, when not flexing under weight of a wearer, a peak-to-peak amplitude dimension of a first adjacent wave trough and wave crest pair in the wave shaped portion may be at least three times greater than a thickness dimension of the rigid plate making up the first adjacent wave trough and wave crest pair (and in some examples, at least five times, at least eight times, at least 12 times, at least 15 times, or even at least 20 times greater). As other examples, when not flexing under weight of a wearer, a peak-to-peak amplitude dimension of a first adjacent wave trough and wave crest pair in the wave shaped portion may be at least 8 mm (and in some examples, at least 10 mm, at least 12 mm, at least 15 mm, at least 20 mm, or even at least 25 mm. In some examples, this peak-to-peak amplitude may be within a range of 8 to 30 mm or within a range of 10 to 25 mm. Additionally or alternatively, if desired, when not flexing under weight of a wearer, a thickness dimension of the rigid plate (including a portion of the rigid plate making up the first adjacent wave trough and wave crest pair) may be less than 8 mm, and in some examples, less than 6 mm, less than 4 mm, or even less than 2.5 mm. As some more specific examples, the rigid plate thickness dimension may be within a range of 1 mm to 10 mm thick or within a range of 1.5 to 8 mm thick.

In some examples of this disclosure, the plantar support component may include a polymer foam material (e.g., polyurethane or ethylvinylacetate foam) and/or it may form at least a portion of a midsole for an article of footwear. The flexible support member may form at least a portion of a midsole for an article of footwear, at least a portion of an outsole for an article of footwear, and/or at least a portion of an impact force attenuation system for an article of footwear. Optionally, foot support members according to some examples of this disclosure may include other components as well, such as: (a) one or more outsole elements located on an opposite side of the flexible support member from the plantar support component (e.g., covering at least a portion of at least some of the plural wave troughs); (b) one or more insole elements; (c) one or more impact force attenuation components, such as one or more fluid-filled bladders, one or more impact force attenuation columns (e.g., made of foam or other suitable materials), one or more mechanical shock or impact force absorbing devices, etc.

Foot support members according to some examples of this disclosure may be located at various areas of an article of footwear or other foot-receiving device. As one more specific example, the wave shaped portion of the flexible support member may extend continuously from a heel region to a toe region of the foot support member and from a lateral side edge to a medial side edge of the foot support member (e.g., and support an entire plantar surface of a wearer's foot). In such a structure, the peaks of the plural wave troughs and the peaks of the plural wave crests may extend in a substantially medial side to lateral side direction. Forces applied to the flexible support member in such example structures may: increase a longitudinal dimension of the foot support member; decrease a longitudinal dimension of the foot support member; apply a tensile force to the plantar support component (e.g., a foam material) or other portion of the foot support member or footwear structure; and/or apply a compressive force to the plantar support component (e.g., a foam material) or other portion of the foot support member or footwear structure.

Shapes of the wave shaped portion of the flexible support member may vary, e.g., depending on the desired features or characteristics of the flexible support member. In some example structures, when the foot support member is oriented on a horizontal surface, at least some of the wave shaped portion may include no overlapping areas in a vertical direction. In such structures, weight of the user (e.g., from landing a step or jump) may tend to flatten out the wave shaped portion, thereby increasing a dimension of the flexible support member and/or applying a tensile force to the plantar support component and/or other component of the foot support member and/or article of footwear. In other example structures, when the foot support member is oriented on a horizontal surface, at least some of the wave shaped portion may include overlapping areas in a vertical direction. In these structures, weight of the user may tend to fold the wave shaped portion, thereby decreasing a dimension of the flexible support member and/or applying a compressive force to the plantar support component and/or other component of the foot support member and/or article of footwear. A single foot support member may include one or more areas of increasing dimensions (e.g., a heel and/or midfoot area) and/or applied tensile force and/or one or more areas of decreasing dimensions and/or applied compressive force (e.g., a forefoot area).

Other example foot support members according to aspects of this disclosure may include the peaks of the plural wave troughs and the peaks of the plural wave crests extending in a substantially "front-to-back" or "heel-to-toe" direction or in a forward medial-to-rear lateral angled direction. One more specific example of this aspect of the disclosure may include the wave shaped portion of the flexible support member located in a forefoot area of the foot support member (e.g., extending at least from a central forefoot region toward a lateral side region of the foot support member, optionally in an area beneath at least some of the metatarsal heads and/or metatarsophalangeal joints). A ground contacting component may be engaged at a free end of the wave shaped portion of the flexible support member, and this ground contacting component may extend laterally outward with respect to a majority of a lateral perimeter edge of the foot support member when the rigid plate of the wave shaped portion flexes under weight of a wearer.

In another example configuration, the wave shaped portion of the flexible support member may be located in a heel region of the foot support member (e.g., with the peaks of the plural wave troughs and plural wave crests extending in a substantially "front-to-back" or "heel-to-toe" direction). If desired, the flexible support member may include one or more side members that extend beyond (above) peaks of the plural wave crests, and the plantar support component may be positioned adjacent the side member(s), e.g., with a space defined between a medial side member and a lateral side member of the flexible support member. Additionally, if desired, a tensioning element (e.g., a wire, cable, or the like) or a spring component may extend between the medial and lateral side members. The tensioning element or spring component may help the side members apply a force to the sides of the plantar support component, a heel counter, and/or other portion of a footwear or foot-receiving device structure.

A single foot support member may include multiple flexible support members (e.g., arranged spaced apart in the front-to-back direction and/or arranged spaced apart in the lateral-to-medial side direction, etc.). While not a requirement, when a foot support member includes multiple flexible support members, the different flexible support members may include the same or different constructions.

Additional aspects of this disclosure relate to footwear and/or other foot-receiving components including one or more foot support members according to one or more aspects of this disclosure. Still additional aspects of this disclosure relate to methods of making articles of footwear and/or other foot-receiving devices that incorporate one or more foot support members according to one or more aspects of this disclosure into the overall footwear or device structures.

As some more specific examples, at least some aspects of this disclosure will have one or more of the features described in the Paragraphs below, including any desired combination(s) of features.

Paragraph 1. A foot support member, comprising: a plantar support component for supporting at least a portion of a plantar surface of a wearer's foot, wherein the plantar support component includes a first surface and a second surface opposite the first surface; and a flexible support member disposed adjacent the second surface of the plantar support component, wherein the flexible support member includes a wave shaped portion, wherein the wave shaped portion is oriented such that plural wave crests extend toward the first surface of the plantar support component and plural wave troughs extend away from the first surface of the plantar support component, wherein the wave shaped portion includes a rigid plate capable of flexing under weight of a wearer, and wherein flexing of the rigid plate under weight of a wearer: (a) causes at least a portion of the rigid plate to become flatter, (b) causes at least a portion of the rigid plate to compress together, (c) changes at least one of a longitudinal or transverse dimension of the foot support member, and/or (d) applies a compressive or tensile force to the plantar support component and/or another part of the foot support member.

Paragraph 2. A foot support member according to Paragraph 1, further comprising an outsole element located on an opposite side of the flexible support member from the plantar support component and covering at least a portion of the plural wave troughs.

Paragraph 3. A foot support member according to Paragraph 1 or Paragraph 2, wherein peaks of the plural wave troughs and peaks of the plural wave crests extend in a substantially medial side to lateral side direction.

Paragraph 4. A foot support member according to Paragraph 3, wherein the wave shaped portion of the flexible support member extends continuously from a heel region to a toe region of the foot support member.

Paragraph 5. A foot support member according to Paragraph 3 or Paragraph 4, wherein flexing of the rigid plate under weight of a wearer causes at least a portion of the rigid plate to become flatter to thereby decrease a peak-to-peak amplitude of at least one adjacent wave trough and wave crest pair.

Paragraph 6. A foot support member according to any one of Paragraphs 3-5, wherein, when the foot support member is oriented on a horizontal surface, the wave shaped portion includes no overlapping areas in a vertical direction.

Paragraph 7. A foot support member according to any one of Paragraphs 3-5, wherein flexing of the rigid plate under weight of a wearer causes at least a portion of the rigid plate to compress together to thereby become more folded.

Paragraph 8. A foot support member according to any one of Paragraphs 3-5 or 7, wherein, when the foot support member is oriented on a horizontal surface, the wave shaped portion includes overlapping areas in a vertical direction.

Paragraph 9. A foot support member according to Paragraph 3, wherein, when the foot support member is oriented on a horizontal surface: (a) a heel or midfoot area of the wave shaped portion includes no overlapping areas in a vertical direction and (b) a forefoot area of the wave shaped portion includes overlapping areas in the vertical direction.

Paragraph 10. A foot support member according to Paragraph 9, wherein flexing the heel or midfoot area of the wave shaped portion under weight of a wearer causes the heel or midfoot area to become flatter to thereby decrease a peak-to-peak amplitude of at least one adjacent wave trough and wave crest pair, and wherein flexing the forefoot area of the wave shaped portion under weight of a wearer causes the forefoot area to compress together to thereby become more folded.

Paragraph 11. A foot support member according to any preceding Paragraph, wherein the plantar support component includes a polymer foam material.

Paragraph 12. A foot support member according to any preceding Paragraph, wherein the second surface of the plantar support component includes a polymer foam material that extends into interior volumes defined by at least some of the plural wave troughs.

Paragraph 13. A foot support member according to any preceding Paragraph, wherein the second surface of the plantar support component includes material that extends into interior volumes defined by at least some of the plural wave troughs.

Paragraph 14. A foot support member according to Paragraph 1 or Paragraph 2, wherein peaks of the plural wave troughs and peaks of the plural wave crests extend in a substantially heel to toe direction.

Paragraph 15. A foot support member according to Paragraph 1 or Paragraph 14, wherein the wave shaped portion of the flexible support member is located in a forefoot area of the foot support member.

Paragraph 16. A foot support member according to any one of Paragraphs 1, 14, or 15, wherein the wave shaped portion of the flexible support member extends from a central forefoot region toward a lateral side region of the foot support member.

Paragraph 17. A foot support member according to any one of Paragraphs 1 or 14-16, further comprising a ground contacting component engaged with the wave shaped portion of the flexible support member, wherein the ground contacting component extends laterally outward with respect to a majority of a lateral perimeter edge of the foot support member when the rigid plate of the wave shaped portion flexes under weight of a wearer.

Paragraph 18. A foot support member according to any one of Paragraphs 1 or 14-17, further comprising a cover element covering the plural wave crests of the wave shaped portion.

Paragraph 19. A foot support member according to Paragraph 1, wherein the wave shaped portion of the flexible support member is located in a heel region of the foot support member.

Paragraph 20. A foot support member according to Paragraph 1 or Paragraph 19, wherein the flexible support member includes a first side member that extends beyond peaks of the plural wave crests.

Paragraph 21. A foot support member according to Paragraph 1 or Paragraph 19, wherein the flexible support member includes a first side member that extends beyond peaks of the plural wave crests and a second side member that extends beyond peaks of the plural wave crests located opposite from the first side member, and wherein the plantar support component is positioned between the first side member and the second side member.

Paragraph 22. A foot support member according to Paragraph 21, further comprising a tensioning element or spring component extending between the first side member and the second side member.

Paragraph 23. A foot support member according to Paragraph 1 or Paragraph 19, further comprising: a second flexible support member disposed adjacent the second surface of the plantar support component in the heel region of the foot support member, wherein the second flexible support member includes a second wave shaped portion, wherein the second wave shaped portion is oriented such that second plural wave crests extend toward the first surface of the plantar support component and second plural wave troughs extend away from the first surface of the plantar support component, wherein the second wave shaped portion of the second flexible support member includes a second rigid plate capable of flexing under weight of a wearer, and wherein flexing of the second rigid plate under weight of a wearer: (a) causes at least a portion of the second rigid plate to become flatter and/or (b) causes at least a portion of the second rigid plate to compress together.

Paragraph 24. A foot support member according to Paragraph 23, wherein the flexible support member extends from a lateral side to a medial side of the plantar support component, and wherein the second flexible support member: (a) is located in the heel region of the foot support member forward of the flexible support member and (b) extends from the lateral side to the medial side of the plantar support component.

Paragraph 25. A foot support member according to Paragraph 23 or Paragraph 24, wherein the flexible support member and the second flexible support member are joined together or formed as a unitary, one piece construction by a link extending between a wave crest peak of the flexible support member and an adjacent wave crest peak of the second flexible support member.

Paragraph 26. A foot support member according to Paragraph 1 or Paragraph 19, further comprising: a second flexible support member disposed adjacent the second surface of the plantar support component in the heel region of the foot support member, wherein the second flexible support member includes a second wave shaped portion, wherein the second wave shaped portion is oriented such that second plural wave crests extend toward the first surface of the plantar support component and second plural wave troughs extend away from the first surface of the plantar support component, wherein the second wave shaped portion of the second flexible support member includes a second rigid plate capable of flexing under weight of a wearer, and wherein flexing of the second rigid plate under weight of a wearer: (a) causes at least a portion of the second rigid plate to become flatter and/or (b) causes at least a portion of the second rigid plate to compress together; and a third flexible support member disposed adjacent the second surface of the plantar support component in the heel region of the foot support member, wherein the third flexible support member includes a third wave shaped portion, wherein the third wave shaped portion is oriented such that third plural wave crests extend toward the first surface of the plantar support component and third plural wave troughs extend away from the first surface of the plantar support component, wherein the third wave shaped portion of the third flexible support member includes a third rigid plate capable of flexing under weight of a wearer, and wherein flexing of the third rigid plate under weight of a wearer:

(a) causes at least a portion of the third rigid plate to become flatter and/or (b) causes at least a portion of the third rigid plate to compress together.

Paragraph 27. A foot support member according to Paragraph 26, wherein the flexible support member extends from a lateral side to a medial side of the plantar support component, wherein the second flexible support member: (a) is located in the heel region of the foot support member forward of the flexible support member and (b) extends from the lateral side to the medial side of the plantar support component, and wherein the third flexible support member: (a) is located in the heel region of the foot support member forward of the second flexible support member and (b) extends from the lateral side to the medial side of the plantar support component.

Paragraph 28. A foot support member according to Paragraph 26 or Paragraph 27, wherein the flexible support member, the second flexible support member, and the third flexible support member are joined together or formed as a unitary, one piece construction by: (a) a first link extending between a wave crest peak of the flexible support member and an adjacent wave crest peak of the second flexible support member and (b) a second link extending between the wave crest peak of the second flexible support member including the first link and an adjacent wave crest peak of the third flexible support member.

Paragraph 29. A foot support member according to any preceding Paragraph, wherein the plantar support component includes a polymer foam material and forms a portion of a midsole for an article of footwear.

Paragraph 30. A foot support member according to any preceding Paragraph, wherein the plantar support component forms a portion of a midsole for an article of footwear.

Paragraph 31. A foot support member according to any preceding Paragraph, wherein the flexible support member forms a portion of a midsole for an article of footwear.

Paragraph 32. A foot support member according to any preceding Paragraph, wherein the flexible support member forms at least a portion of an impact force attenuation system for an article of footwear.

Paragraph 33. A foot support member according to any preceding Paragraph, wherein, when not flexing under weight of a wearer, a peak-to-peak amplitude dimension of a first adjacent wave trough and wave crest pair in the wave shaped portion is at least three times greater than a thickness dimension of the rigid plate making up the first adjacent wave trough and wave crest pair.

Paragraph 34. A foot support member according to any one of Paragraphs 1-32, wherein, when not flexing under weight of a wearer, a peak-to-peak amplitude dimension of a first adjacent wave trough and wave crest pair in the wave shaped portion is at least eight times greater than a thickness dimension of the rigid plate making up the first adjacent wave trough and wave crest pair.

Paragraph 35. A foot support member according to any one of Paragraphs 1-32, wherein, when not flexing under weight of a wearer, a peak-to-peak amplitude dimension of a first adjacent wave trough and wave crest pair in the wave shaped portion is at least fifteen times greater than a thickness dimension of the rigid plate making up the first adjacent wave trough and wave crest pair.

Paragraph 36. A foot support member according to any preceding Paragraph, wherein, when not flexing under weight of a wearer, a peak-to-peak amplitude dimension of a first adjacent wave trough and wave crest pair in the wave shaped portion is at least 8 mm.

Paragraph 37. A foot support member according to Paragraph 36, wherein, when not flexing under weight of a wearer, a thickness dimension of the rigid plate making up the first adjacent wave trough and wave crest pair is less than 4 mm.

Paragraph 38. A method of manufacturing a foot support member, comprising: providing a plantar support component for supporting at least a portion of a plantar surface of a wearer's foot, wherein the plantar support component includes a first surface and a second surface opposite the first surface; and providing a flexible support member disposed adjacent the second surface of the plantar support component, wherein the flexible support member includes a wave shaped portion, wherein the wave shaped portion is oriented such that plural wave crests extend toward the first surface of the plantar support component and plural wave troughs extend away from the first surface of the plantar support component, wherein the wave shaped portion includes a rigid plate capable of flexing under weight of a wearer, and wherein flexing of the rigid plate under weight of a wearer: (a) causes at least a portion of the rigid plate to become flatter, (b) causes at least a portion of the rigid plate to compress together, (c) changes at least one of a longitudinal or transverse dimension of the foot support member, and/or (d) applies a compressive or tensile force to the plantar support component and/or another part of the foot support member. The foot support member, plantar support component, and/or flexible support member utilized in this method may have any one or more of the features described in the Paragraphs above and/or any desired combination of the features described in the Paragraphs above.

Given the general description of features, aspects, structures, and arrangements according to the disclosure provided above, a more detailed description of specific example articles of footwear and foot support components in accordance with this disclosure follows.

II. DETAILED DESCRIPTION OF EXAMPLE SOLE STRUCTURES AND ARTICLES OF FOOTWEAR ACCORDING TO THIS DISCLOSURE

Referring to the figures and following discussion, various sole structures, articles of footwear, and features thereof in accordance with the present disclosure are disclosed. The sole structures and footwear depicted and discussed are athletic shoes, and the concepts disclosed with respect to various aspects of this footwear may be applied to a wide range of athletic footwear styles, including, but not limited to: walking shoes, tennis shoes, soccer shoes, football shoes, basketball shoes, running shoes, cross-training shoes, cleated shoes, golf shoes, etc. In addition, at least some concepts and aspects of the present disclosure may be applied to a wide range of non-athletic footwear and/or other foot-receiving devices, including work boots, sandals, loafers, dress shoes, ski boots, ski bindings, etc. Accordingly, the present disclosure is not limited to the precise embodiments disclosed herein, but it applies to footwear and other foot-receiving devices generally.

FIGS. 1A through 1E illustrate various views of an example sole structure 104 for an article of footwear 100 that includes at least some aspects of this disclosure. For purposes of this disclosure, and as shown in FIG. 1A, portions of an article of footwear (and the various component parts thereof) may be identified based on regions of the foot located at or near that portion of the article of footwear when the footwear is worn on the properly sized foot. For example, as shown in FIG. 1A, an article of footwear 100 and/or a sole structure 104 may be considered as having a "forefoot region" at the front of the foot, a "midfoot region" (or "arch region") at the middle or arch area of the foot, and a "heel region" at the rear of the foot. Footwear 100 and/or sole structures 104 also include a "lateral side" (referring to the "outside" or "little toe side" of the foot) and a "medial side" (referring to the "inside" or "big toe side" of the foot). The forefoot region generally includes portions of the footwear or components thereof corresponding to the toes and the joints connecting the metatarsals with the phalanges. The midfoot region generally includes portions of the footwear or components thereof corresponding with the arch area of the foot. The heel region generally includes portions of the footwear or components thereof corresponding to the rear portions of the foot, including the calcaneus bone. The lateral and medial sides of the footwear or components thereof may extend through the forefoot, midfoot, and/or heel regions and generally correspond with opposite sides of the footwear (and may be considered as being separated by a central longitudinal axis). These regions (although separated by dividing lines in FIG. 1A) and sides are not intended to demarcate precise areas of footwear. Rather, the terms "forefoot region," "midfoot region," "heel region," "lateral side," and "medial side" are intended to represent general areas of an article of footwear and the various components thereof to aid the in discussion that follows.

FIG. 1A generally illustrates an article of footwear 100 that includes an upper 102 and a sole structure 104 engaged with the upper 102. The sole structure 104 may be engaged with the upper 102 (e.g., to provide the overall footwear structure 100) in any desired manner without departing from this disclosure, including in conventional manners as are known and used in this art. As some more specific examples, the upper 102 and sole structure 104 may be engaged together by adhesives or cements, by mechanical connectors, by stitching or sewing, by fusing, and/or by other connection techniques.

The upper 102 may constitute one or multiple component part constructions that may be engaged together in any desired manner, including in conventional manners as are known and used in the footwear art, including through the use of cements or adhesives, through the use of mechanical connectors, through the use of sewing or stitching, and/or through fusing techniques (e.g., melt or fuse bonding of a hot melt material, etc.). Also, the upper 102 may be made from any desired materials and/or combinations of materials without departing from this disclosure, including materials that are conventionally known and used in the footwear art. As some more specific examples, the upper 102 may include a multi-layered construction, with the various layers covering all or some portion of the overall upper area. In some even more specific examples, the upper 102 may include an intermediate mesh layer covered and/or sandwiched in at least some areas by an interior fabric or textile layer (e.g., for comfortable contact with the foot) and/or an exterior "skin" layer (e.g., made from a thermoplastic polyurethane film, to provide better support at certain areas, to provide wear or abrasion resistance in certain areas, to provide desired aesthetics, etc.). None of the interior fabric or textile layer, the mesh layer, and/or the skin layer needs to extend to provide and/or cover an entire surface of the upper 102. Rather, the location(s) of the various layers may be selected to control the properties of the upper 102, e.g., by omitting the skin layer at certain areas to improve breathability, to improve flexibility, to provide a different aesthetic appearance (such as openings in the skin layer to produce a "LOGO" or other design feature from the underlying mesh material), to provide abrasion or wear resistance, etc. Also, as is known in the art, the upper 102 may define an ankle opening 106 or other appropriate opening for receiving a foot, around which a comfort-enhancing foam or fabric ring may be provided, if desired. The bottom surface of the upper 102 may include an interior strobel member or other component that connects the medial and lateral sides of the upper material(s) (e.g., the strobel member may be sewn to the medial and lateral side edges of the upper) to thereby close off the upper 102 and/or provide a sole attachment surface. The sole structure 104 may be engaged with the upper 102 at its bottom edges and with the strobel, e.g., using cements or adhesives, stitching or sewing, mechanical connectors, fusing techniques, etc.

A multi-layered upper construction may be produced in any desired manner without departing from this disclosure, including in conventional manners as are known and used in the footwear art. For example, if desired, the skin layer may be made from a "no-sew" type material that may be adhered to the underlying mesh layer (or other layer) using an adhesive or hot melt material, e.g., by application of heat and/or pressure. As additional examples, if desired, the skin layer may be engaged with the underlying mesh layer (or other layer) by cements or adhesives and/or by sewn seams. As yet additional examples, if desired, the upper 102 (or portions thereof) may be constructed by bonding various layers of materials using fusing techniques, e.g., as described in U.S. Pat. Nos. 8,429,835 and 8,321,984, each of which is entirely incorporated herein by reference.

The upper 102 may include other support elements at desired locations, e.g., sandwiched between the exterior skin layer and the underlying mesh layer. For example, a heel counter may be provided in the heel area to provide more support for the wearer's heel. The heel counter, when present, may be made from a rigid, thin plastic material, such as PEBAX, TPU, fiber reinforced plastics (e.g., carbon fiber or fiberglass), or other polymeric material, and it may include one or more openings (e.g., to control flexibility, breathability, support characteristics; to reduce weight; etc.). If necessary or desired, additional supports and/or components may be provided in other areas of the shoe 100, such as in the forefoot or toe area (to provide protection and wear resistance, to provide shape support, etc.), at the lateral side area near the fifth metatarsal head, etc.

Other potential materials that may be used in uppers 102 in accordance with at least some examples of this disclosure include one or more of: synthetic leather, natural leather, textiles, thermoplastic polyurethanes, any combination of these materials, and/or any combinations of these materials with any of the other materials described above. As another potential feature, if desired, at least some portion of the upper 102 may be formed by a knitting procedure, such as flat knitting, circular knitting, etc. Optionally, at least a majority (or even all) of the upper 102 may be formed using knitting procedures, in at least some examples of this disclosure. Knitted textile components can be used to provide lightweight, breathable, and comfortable upper constructions.

Figure 1B:
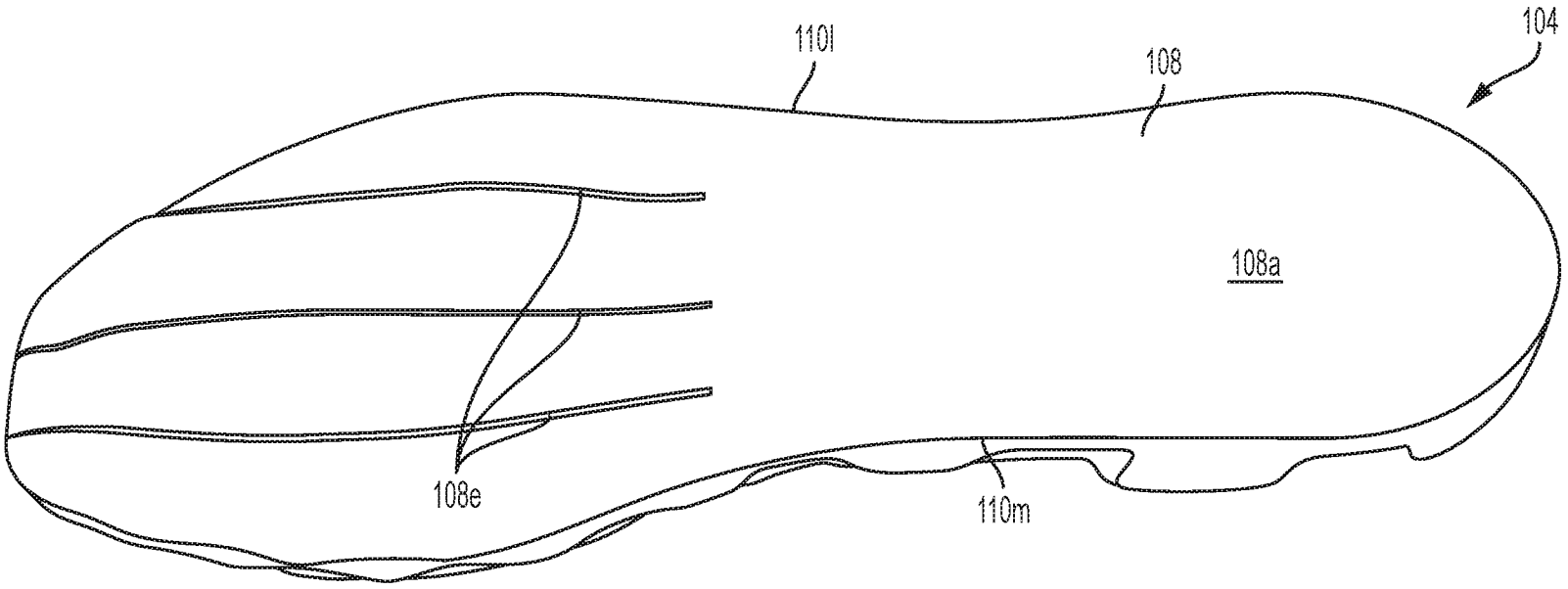
FIGS. 1B through 1E, which illustrate various views of an example foot support member that includes a dynamically transformative support component in accordance with some aspects of this disclosure.
Figure 1C:
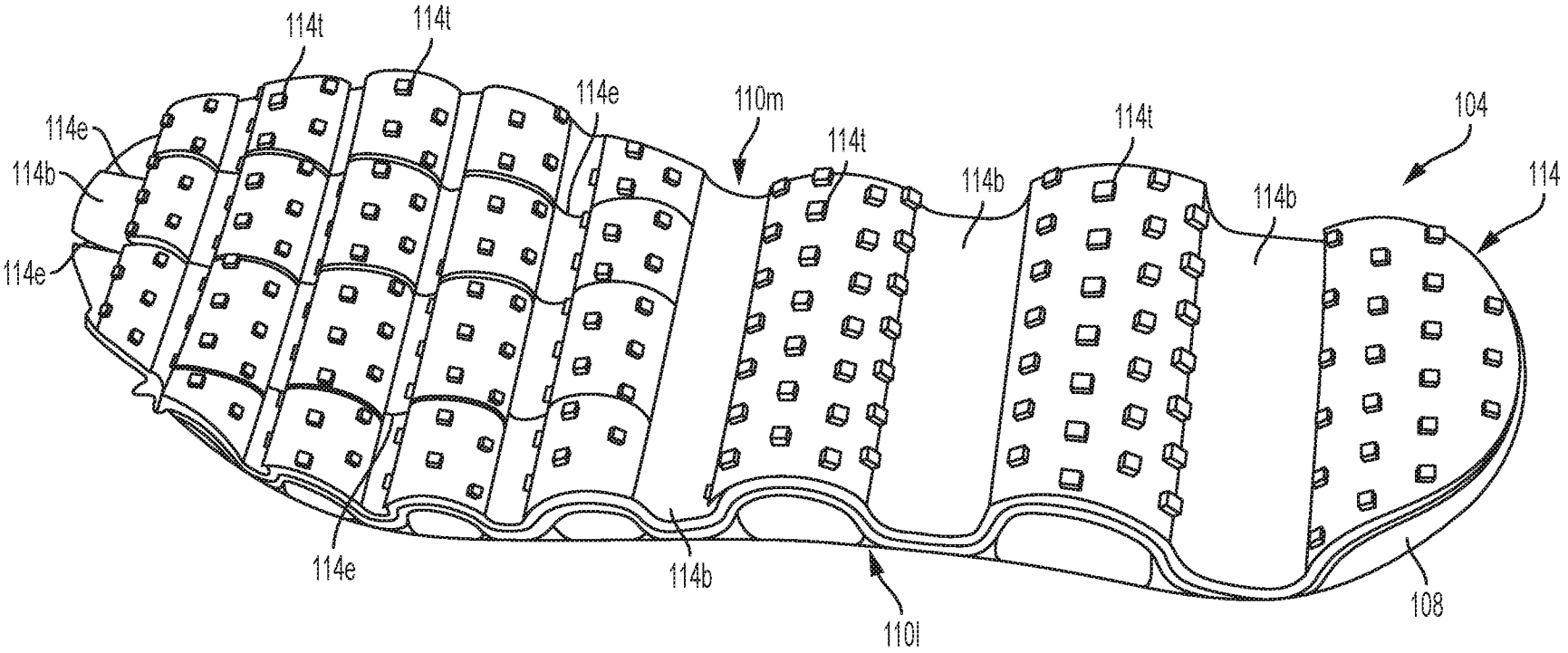
Figure 1D:
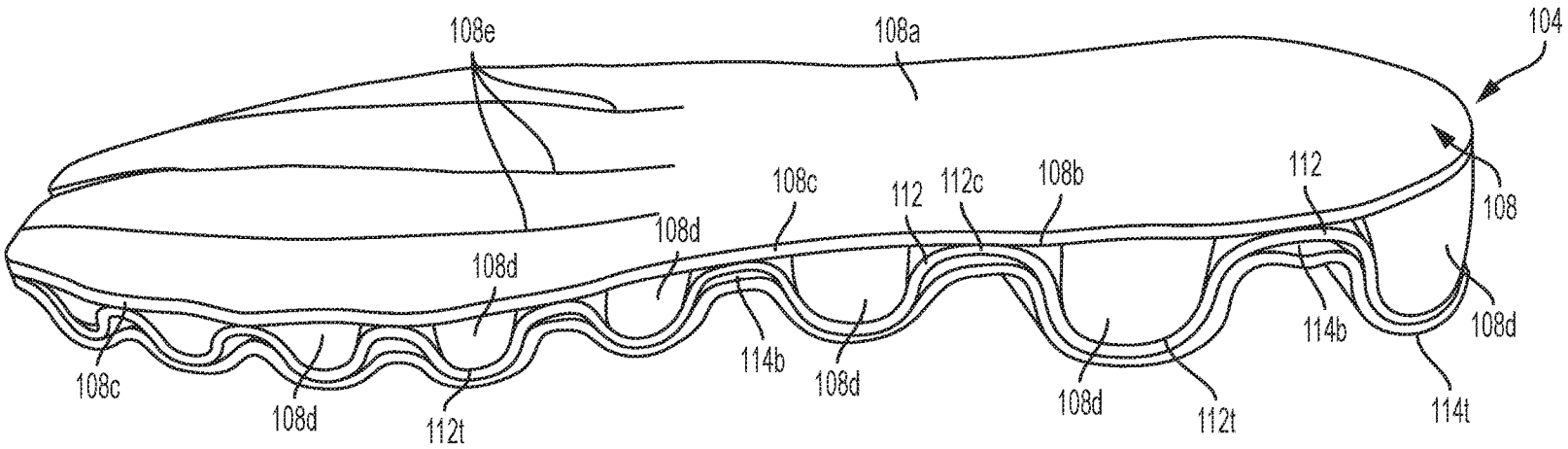

An example sole structure 104 that may be used in articles of footwear 100 of this type now will be described in more detail in conjunction with FIGS. 1B through 1E. FIG. 1B provides a top view, FIG. 1C provides a bottom view, and FIGS. 1C and 1D provide different perspective views of this example sole structure 104. While discussed in terms of a sole structure for an article of footwear, those skilled in the art, given the benefit of this disclosure, would understand that element 104 could be used as a foot support member for other types of articles of footwear and/or foot-receiving devices.

FIG. 1B shows the top of a sole structure 104 according to some examples of this disclosure disengaged from an upper so that the plantar support surface 108*a* of the plantar support component 108 is exposed. In this example, the plantar support component 108 extends completely: (a) from the rearmost heel area to a foremost toe area of the sole structure 104 and (b) from a lateral side edge 1101 to a medial side edge 110*m* of the sole structure 104, to thereby support an entire plantar surface of the wearer's foot. Other options, as will be described in more detail below, will include a plantar support component that supports one or more portions of a wearer's foot (and not the complete foot). The top surface 108*a* in this illustrated example is relatively flat or smoothly curved and contoured (e.g., contoured to conform to and/or better support a plantar surface of a wearer's foot). In addition to the first or top plantar support surface 108*a*, this plantar support component 108 includes a second (e.g., bottom) surface 108*b* (see FIGS. 1D and 1E) opposite the first surface 108*a*.

The plantar support component 108 may be a single piece or multi-piece construction. In some examples of this disclosure, that plantar support component 108 will be made from an impact force attenuating material, such as a polyurethane or ethylvinylacetate based foam material. Other suitable impact force attenuation materials and structures can be used without departing from this disclosure, including foams and other midsole materials as are conventionally known and used in the footwear art. The example of FIGS. 1B-1D shows a multi-part construction including a relatively flat and thin base member 108*c* (including plantar support surface 108*a*) and lobes 108*d* extending downward to make the bottom surface 108*b* somewhat lobed or wavy in structure. When made of multiple components, the various parts 108*c* and 108*d* may be engaged in any desired manner, such as via adhesives or fusing techniques. Alternatively, if desired, the base member 108*c* and one or more lobes 108*d* can be made as a single part, e.g., via a molding process (such as injection molding).

FIG. 1B (as well as FIGS. 1C and 1D) further shows that the plantar support component 108 of this example includes flex lines 108*e* formed therein. In the illustrated example, flex lines 108*e* are slits or grooves cut completely through the plantar support component 108 to make the forefoot area of the plantar support component 108 flexible along the flex lines 108*e*. While three flex lines 108*e* are shown in FIGS. 1B-1D (with lines 108*e* corresponding to gaps between adjacent sets of phalanges and metatarsal bones in the foot), more or fewer flex lines 108*e* could be provided, if desired. While shown primarily in the forefoot region and extending to the front toe edge of the plantar support component 108, the flex lines 108*e* can extend any desired distance along the plantar support component 108. Additionally or alternatively, depending on the type and magnitude of flexibility desired, one or more flex lines 108*e* may be provided in the arch and/or heel areas of the article of footwear and/or one or more flex lines may be oriented in a generally medial-to-lateral side direction and/or in a diagonal direction.

The flex lines 108*e*, when present, can help improve the sole structure 104 flexibility (particularly as the foot rolls from the lateral side to the medial side and pushes off the ground over the course of a step cycle) and provide a more natural motion feel and flow during use of the sole structure 104. A waterproof and/or breathable membrane or other component (such as a GORE-TEX® fabric available from W.L. Gore & Associates) may be provided over the flex lines 108*e* (e.g., along surface 108*a*, on the bottom surface of upper 102, etc.) to prevent water (or other undesired materials) from reaching the foot and the foot-containing chamber of the footwear structure.

The sole structure 104 in this example further includes a wave shaped flexible support member 112 located adjacent (beneath) the second surface 108*b* of the plantar support component 108. This flexible support member 112 includes a wave shaped portion oriented such that plural wave crests 112*c* extend toward the first surface 108*a* of the plantar support component 108 and plural wave troughs 112*t* extend away from the first surface 108*a* of the plantar support component 108. The exterior surfaces of the wave crests 112*c* and/or wave troughs 112*t* may have a rounded or curved shape. See FIGS. 1D and 1E. Alternatively, if desired, the crest and/or trough peaks may have somewhat flattened top and/or bottom surfaces, e.g., to provide more surface area for supporting or engaging other footwear components, the ground, and/or the wearer's foot.

The wave shaped portion of the flexible support member 112 (and indeed the entire flexible support member 112) may be constructed as a rigid plate capable of flexing under weight of a wearer and then returning to its original (or substantially original) size, shape, and dimensions when the force is sufficiently relaxed or removed. As some more specific examples, the flexible support member 112 (or at least a wave shaped portion thereof) may be formed from a plastic material, such as PEBAX® (a thermoplastic elastomer made up of block copolymers of polyamide and polyether segments available from Arkema), thermoplastic or thermoset polyurethanes, carbon-reinforced fiber plates, and the like.

In the example structure shown in FIGS. 1B-1E, the wave shaped portion of the flexible support member 112 extends continuously from the heel region to the toe region of the foot support member 104 and continuously across the foot support member 104 from the medial side edge to the lateral side edge thereof. Also, in this illustrated structure 112, the peaks of the plural wave troughs 112*t* and the peaks of the plural wave crests 112*c* extend in a substantially medial side to lateral side direction and extend continuously from the medial side edge to the lateral side edge. Note, particularly, FIGS. 1C and 1E. Other options are possible, some of which will be discussed in more detail below in conjunction with other examples of this disclosure.

Figure 1E:
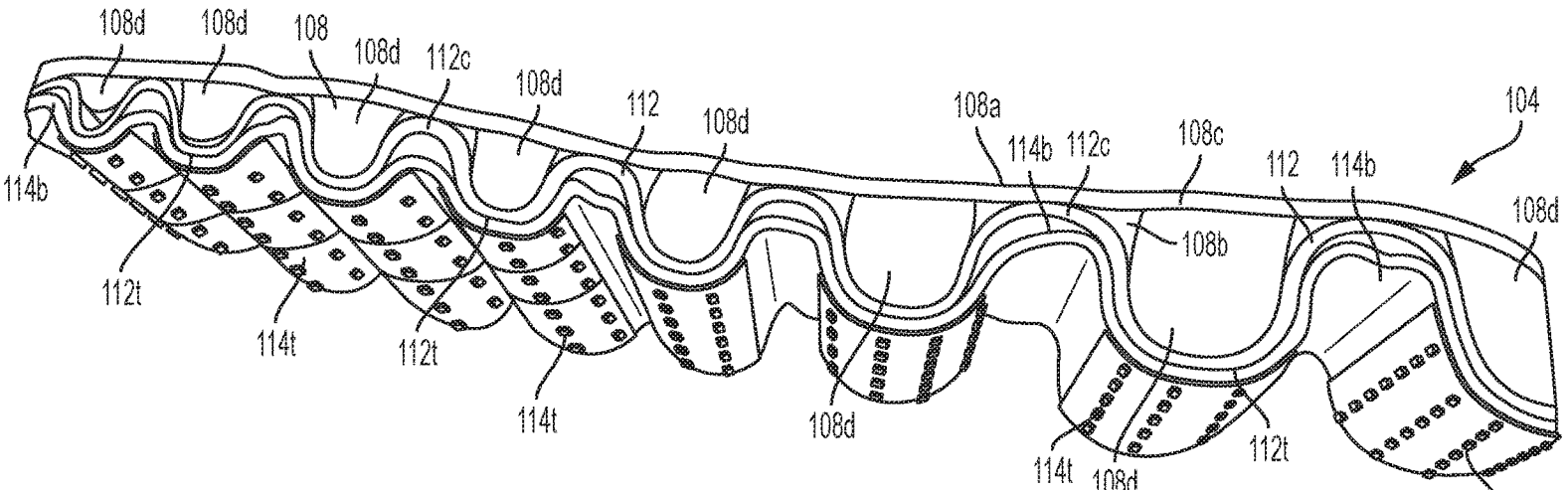

As illustrated in FIGS. 1D and 1E, in this illustrated example, the bottom surface 108*b* of the plantar support component 108 is also somewhat "wave shaped" such that the lobes 108*d* thereof extend into interior volumes of the sole structure 104 defined by at least some of the plural wave troughs 112*t* of the flexible support member 112. The lobes 108*d* may be formed of a polymer foam material, and optionally, may be formed as a single piece construction with the remainder of the plantar support component 108 (e.g., by injection molding, etc.). The lobes 108*d* provide additional impact force attenuation and a more comfortable feel, e.g., when the wearer lands a step or a jump.

FIGS. 1B-1E further illustrate that this example sole structure 104 includes an outsole component 114 located on an opposite side of the flexible support member 112 from the plantar support component 108. This illustrated example outsole component 114 includes multiple component parts including a single outsole base 114*b* and several outsole tread elements 114*t*. The outsole base 114*b* (when present) may at least substantially (and in some instances completely) cover the flexible support member 112 (and may be wave shaped so as to match up to and/or closely correspond to the exterior surface of wave troughs 112*t* and crests 112*c* of the flexible support member 112). The optional outsole base 114*b* may protect the components above it, strengthen the overall foot support/sole structure 104, provide water or penetration resistance, and/or control the stiffness of the overall foot support/sole structure 104. While FIGS. 1B-1E show the outsole base 114*b* completely covering the flexible support member 112, other options are possible, for example, options in which: the outsole base 114*b* covers less than 100% of a bottom surface of the flexible support member 112; the outsole base 114*b* is provided as plural, discrete components at various locations over the bottom surface of the flexible support member 112 (e.g., at one or more of the heel area, the arch area, and/or the forefoot area); and/or the outsole base 114*b* is omitted from the footwear structure.

The outsole tread elements 114*t* in this example are applied at the wave troughs 112*t* of the flexible plate 112 (and to corresponding wave troughs of the outsole base 114*b* in this example), e.g., by an adhesive or cement. The tread elements 114*t* have materials and/or structures for providing improved traction at contact surface or ground-engaging locations of the sole structure 104. While the example of FIGS. 1B-1E show the traction elements 114*t* extending continuously and completely across the area of each wave trough, other options are possible, including, for example: multiple separated traction elements 114*t* provided on a single wave trough (e.g., with gaps between the traction elements); a single traction element 114*t* provided on a wave trough that extends less than all the way across that trough; no traction element provided on one or more wave troughs; etc. Alternatively, if desired, the outsole 114 may be completely eliminated, e.g., and the exterior surface of the flexible support member 112 (at least the trough peaks thereof) may have materials and constructions suited for contacting the ground or other contact surface.

As mentioned above, the plantar support component 108 of this illustrated example may have lines of flex 108*e* formed in it. If desired, the flexible support member 112 and/or the outsole component 114 (e.g., the outsole base 114*b* (if present) and/or one or more of the tread element(s) 114*t* (if present)) may include corresponding flex lines formed in them so as to further support and enhance the desired flexibility and/or natural motion characteristics of the sole structure 104. FIG. 1C shows examples of flex lines 114*e* formed in (e.g., cut through) the outsole base 114*b* and the forefoot oriented outsole tread elements 114*t*. As noted above, if necessary or desired, a waterproof and/or breathable membrane or other component may be provided over the flex lines 108*e* (e.g., along surface 108*a*, on a strobel member, etc.) to prevent water (or other undesired materials) from reaching the foot and the foot-containing chamber of the footwear structure through the flex lines formed in the various sole structure components.

The example sole structure 104 of FIGS. 1B-1E shows a structure in which the flexible support member 112 is made as a separate part from and separately engaged with the plantar support component 108 and/or the outsole component 114 (e.g., by cements or adhesives, by fusing techniques, by mechanical connectors, etc.). Other options are possible. For example, the sole structure 104 shown in FIG. 1A (and in FIGS. 2B and 2C) includes the flexible support member 112 at least partially embedded into a polymer foam midsole material making up the plantar support component 108 (e.g., a polyurethane or EVA type foam material). In such an example structure, the flexible support member 112 may not extend to the extreme medial and lateral edges of the plantar support component 108, although it may be exposed at some areas (such as near the wave crest peaks in gaps G produced in the plantar support component 108). While such an embedded component can be made in any desired manner, in one example, a previously produced flexible support member 112 can be placed in a mold and then the foam material making up the plantar support component 108 may be injection molded and formed around that flexible support member 112.

Figure 2A:
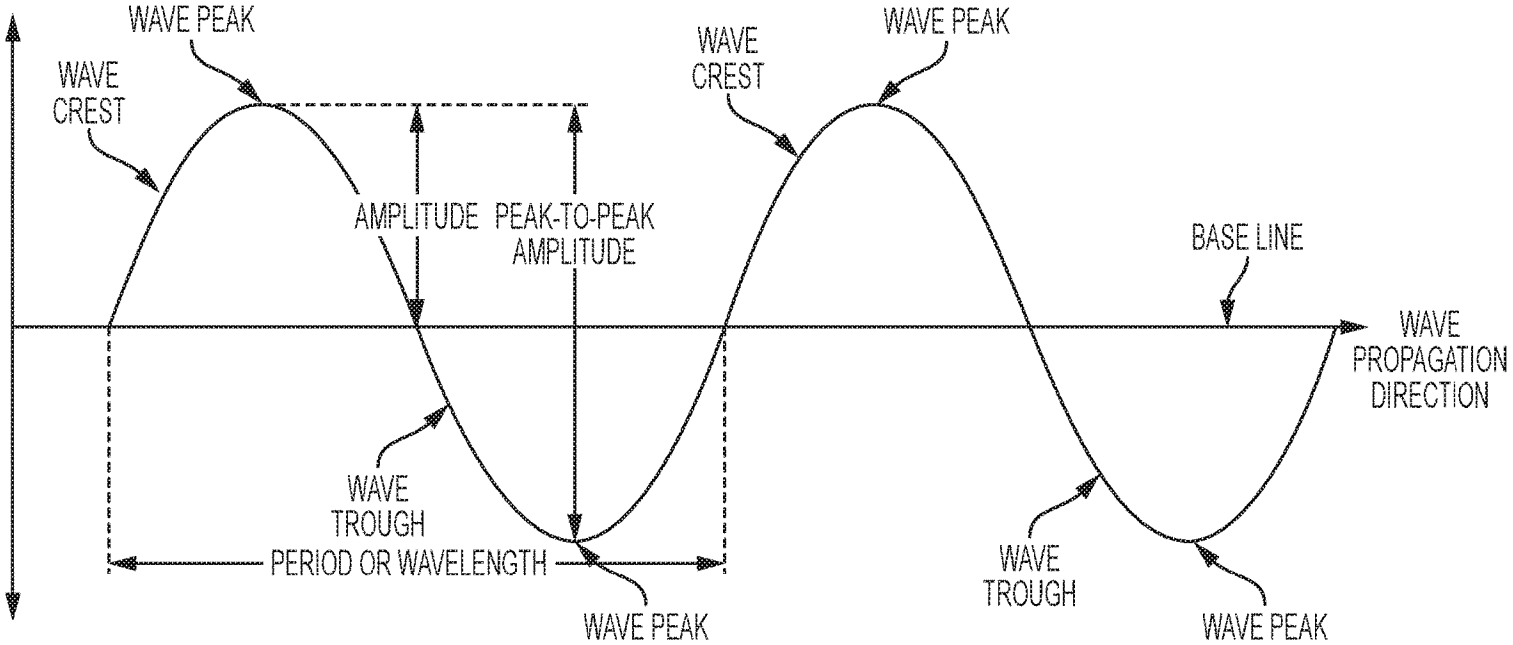
FIGS. 2A through 2C, which illustrate various features of example wave shaped portions of flexible support members that may be used in dynamically transformative support components in accordance with some aspects of this disclosure.

Example features of foot support structures according to some examples of this disclosure now will be described in conjunction with FIGS. 1A-2C. First, some wave terminology as used in this specification is described in conjunction with FIG. 2A. FIG. 2A shows a waveform of a shape generally like that of a longitudinal cross section of the wave shaped portion of the flexible support member 112 shown in FIGS. 1B-1E. As shown, the "wave crests" of this waveform are the areas above the base line and the "wave troughs" are the areas below the base line. The wave "peaks" are the locations (both top and bottom locations) of local maxima and minima of the wave shape (locations where the wave has a horizontal tangent in FIG. 2A). The wave "amplitude" is the distance from the base line to a wave peak (a vertical distance in FIG. 2A), and the wave "period" or "wavelength" is the distance from a location on one wave to the corresponding location on a next adjacent wave (a horizontal distance in FIG. 2A). FIG. 2A further illustrates the meaning of the term "peak-to-peak amplitude" as used in this specification, which corresponds to a distance from one wave crest peak to an adjacent wave trough peak (a vertical distance in FIG. 2A).

While FIG. 2A shows a regular waveform (e.g., one in which the amplitude and period remain constant), wave shaped portions of flexible support members 112 in accordance with examples of this disclosure may have non-regular or non-constant waveform shapes. For example, as shown in FIGS. 1C-1D, the waveform of the wave shaped portion of flexible support member 112 in this illustrated example of the disclosure vary in amplitude, period, and/or peak-to-peak amplitude over the overall length of the waveform (e.g., as one moves in the wave propagation direction). More specifically, as shown in FIGS. 1C-1E, the wave shaped portion of flexible support member 112 (and the outsole base 114*b*) in this illustrated example has a generally decreasing amplitude, decreasing peak-to-peak amplitude, and decreasing wavelength (or period) as one moves in the direction from the heel area to the forefoot area of the sole structure 104.

Also, in the example sole structure 104 shown in FIGS. 1B-1E, when the foot support member (e.g., the sole structure 104) is oriented on a horizontal surface H, the wave shaped portion of the flexible support member 112 includes no overlapping areas in the vertical direction. In other words, in the orientation generally shown in FIG. 2B (i.e., with the sole member 104 sitting on a horizontal surface H in an "unloaded" condition), there are no areas of the wave shaped portion of the flexible support member 112 in which a vertical line or plane V cuts through the flexible support member 112 at two (or more) vertically separated locations. More generically, in this example structure 112, a line or plane perpendicular to the wave propagation direction will not intersect the waveform at multiple, spaced locations along that perpendicular line or plane. Stated yet another way, in this illustrated example, when moving along the waveform, one always moves forward in the wave propagation direction.

Figure 2B:
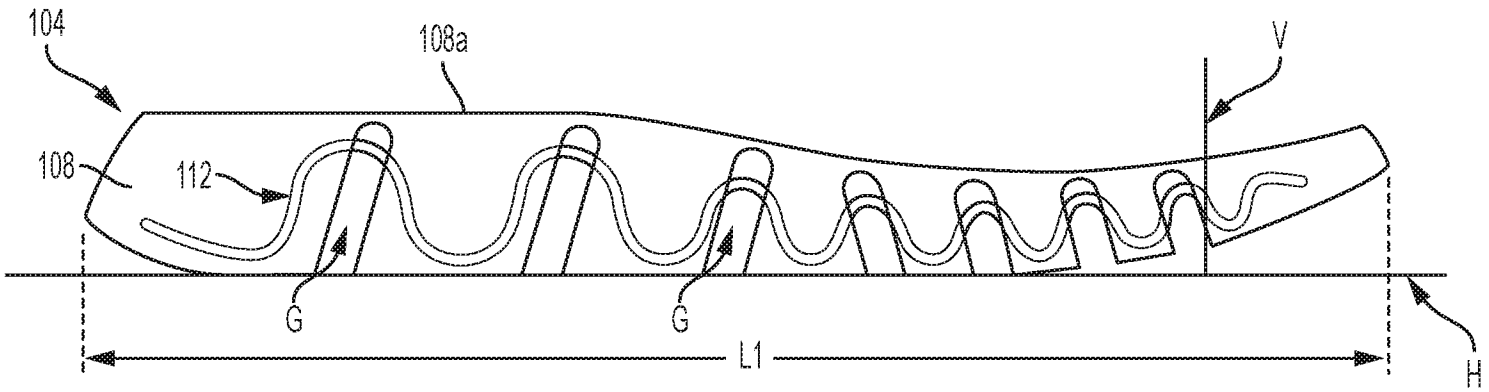
Figure 2C:
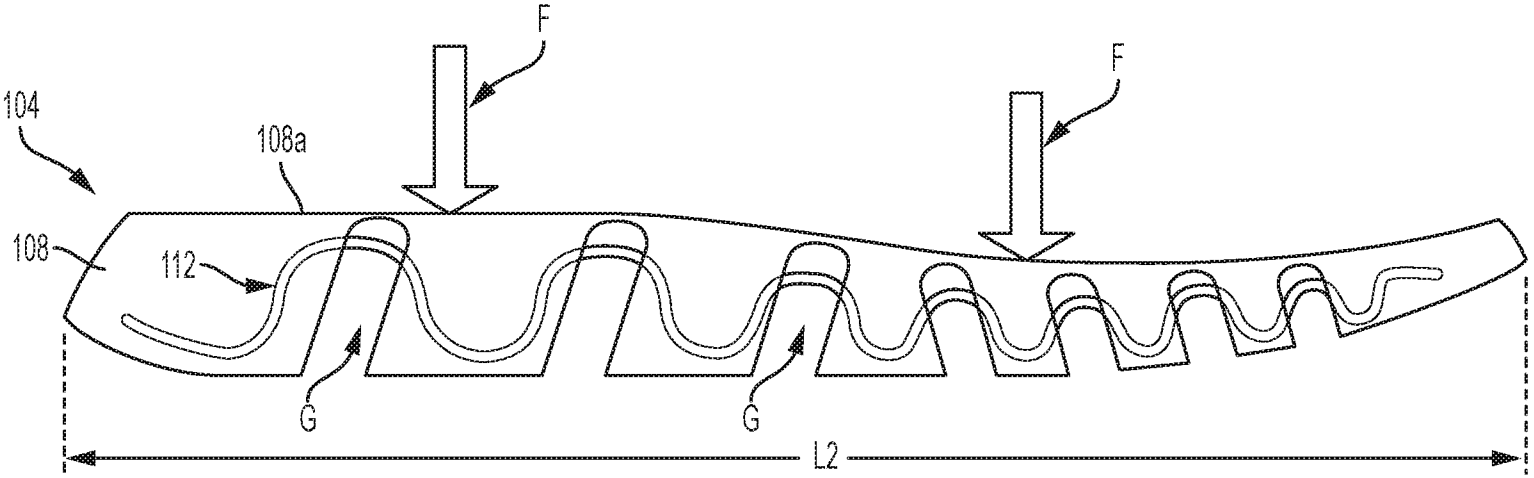

In use, when the example sole structure 104 of FIG. 2B is exposed to a force F (e.g., an impact force compressing the sole structure 104 from a user landing a step or jump), this will cause areas of the wave shaped portion of the flexible support member 112 exposed to the force to: (a) flatten (e.g., reduce the peak-to-peak amplitude) and/or (b) spread apart (e.g., increase in wavelength or period). FIG. 2B diagrammatically shows the foot support member 104 before a force is applied to it (e.g., with the wearer's foot in the air, off a contact surface; standing free, with no wearer; etc.). Then when exposed to a sufficient force F, as shown in FIG. 2C, flexing of the flexible support member 112 causes the sole member 104 to increase in overall length (from L1 to L2) (also shown by increased longitudinal dimensions of the gaps G in the example sole structure 104). When the force F is adequately released or relaxed, the flexible support member 112 (and the remainder of the sole structure 104) will then return (or at least substantially return) to its original size, shape, and dimensions (e.g., back to the form shown in FIG. 2B) due to the flexibility and resilient nature of the flexible support member 112. Also, the magnitude of the force F may impact the degree to which the wave-shaped portion 112 changes shape (e.g., flattens out or spreads apart), e.g., on a landing-by-landing basis. Therefore, when walking, a first type of response/property may be felt by the wearer, but a substantially different response/property may be felt by the wearer if he/she begins to jog, run, sprint, jump, etc. The response/feel may change back to substantially the original response/feel as the wearer again begins walking. These changes in response/feel properties occur simply as a natural response to the contact force of the landing. No changes are required other than the change in impact force. Changes in response and/or feel properties may take place on a step-by-step and/or action-by-action basis.

While FIGS. 2B and 2C show application of a uniform vertical force F at all locations on the plantar support surface 108*a*, this is not a requirement. For example, in a conventional step cycle (e.g., running, jogging, or walking), a person typically lands on the lateral side (outside) of the rear heel area of the foot. Thus, the force from landing a step is concentrated at the rear, outside (lateral) heel area. As the step continues, the weight of the person (and thus the force applied to flexible support member 112) typically rolls from the heel area toward the forefoot area and from the lateral side (outside) toward the medial side (inside) of the sole structure 104. The person typically pushes off from the ground or contact surface (at which point the force is released or relaxed) with the person's weight concentrated at an area beneath the first and/or second metatarsal heads and/or the first and/or second toes (i.e., the inside or medial side toes or metatarsal heads). Because of the waveform shape of the flexible support member, areas of the sole structure 104 can change in dimensions independent of other areas of the sole structure 104, e.g., as the force moves from heel-to-toe and from the lateral side to the medial side. For example, during a typical step cycle, as the person lands on the lateral heel area, the heel area of the sole structure 104 may expand somewhat in its length dimension, and as the weight rolls forward to the forefoot area, the heel area can return to its original dimensions while the forefoot area of the sole structure may expand somewhat it its length dimension.

Flexing of the wave shaped portion of the flexible support member 112 can provide various functions. First, the flexibility can help attenuate ground reaction forces (e.g., from landing the step or jump, from pushing off for a step or jump, etc.) as the applied forces are absorbed by the flexing support member 112 (thereby providing a softer "feel" on the landing and/or push off).

Second, increasing the dimensions of the sole member 104 (and other portions of the shoe 100) somewhat when landing a step or jump and/or pushing off for a step or jump can make the footwear more comfortable to the wearer. More specifically, when the human foot is exposed to impact and pushing off forces, it may flatten out, splay, and/or change in dimensions somewhat under the force. By expanding the size of the sole structure 104 somewhat (and potentially other portions of the shoe, such as the upper, the foot-containing chamber, the strobel member, etc.), this creates more room in the shoe to accommodate the temporarily expanded size of the foot (thereby avoiding pinching, excessive tightness, etc.) and provides a more natural motion and feel.

In addition or as an alternative to changing dimensions of the flexible support member 112, if desired, flattening of the wave shaped portion of the flexible support member 112 under an applied force may be used to apply a force to the plantar support component 108 and/or another part of the foot support member 104 and/or article of footwear 100 (or other foot-receiving device). For example, the force tending to cause the wave shaped portion of the flexible support member 112 to flatten and expand in size may be absorbed, at least in part, by one or more of transferring some force to: the plantar support component 108; the foot support member 104 (e.g., a foam midsole material, a mechanical shock absorbing element, etc.); a footwear upper; and/or a strobel member. This force transfer action may place one or more of these parts under a compressive or tensile force.

Accordingly, depending on the desired characteristics of the overall foot support member 104, article of footwear 100, and/or other foot-receiving device, others components of a foot support member 104, article of footwear 100, and/or other foot-receiving device may include structures or properties to: (a) accommodate the forces and/or dimensional changes induced in the wave shaped portion of the flexible support member 112 (e.g., to stretch or compress relatively freely along with the flexible support member 112), (b) resist these forces and/or dimensional changes (e.g., to absorb the forces applied by the flexible support member 112), and/or (c) partially resist and partially accommodate these forces and/or dimensional changes (e.g., to stretch or compress to a limited extent). As one more specific example, if desired, the flexible support member 112 may be used in combination with a polymer foam midsole material that is sufficiently flexible and/or stretchable so as to substantially change dimensions along with the flexible support member 112. As another example, the sole member 104 may be engaged with a footwear upper or other footwear part having a strobel member (e.g., a component closing off the bottom of the upper (and/or forming a bottom surface of the upper) and engaged with the top surface 108*a* of the plantar support component 108) that is sufficiently stretchable so as to accommodate a desired degree of stretch for the foot-receiving chamber of the upper (and thus allow the foot-receiving chamber of the upper to substantially change size along with the sole member 104).

Figure 3A:
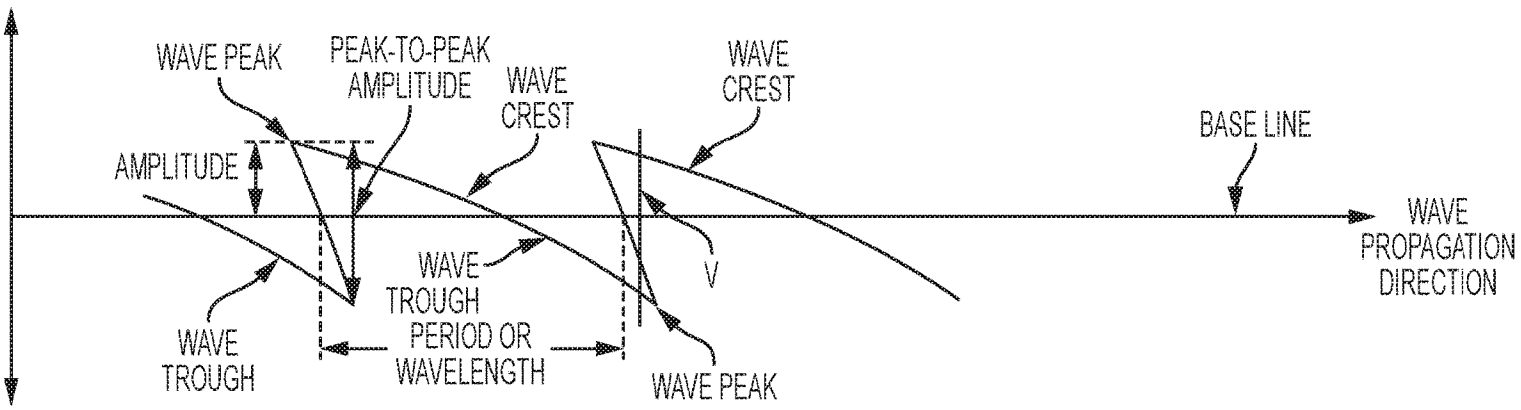
FIGS. 3A through 3C, which illustrate various features of example wave shaped portions of flexible support members that may be used in dynamically transformative support components in accordance with some aspects of this disclosure.
Figure 3B:
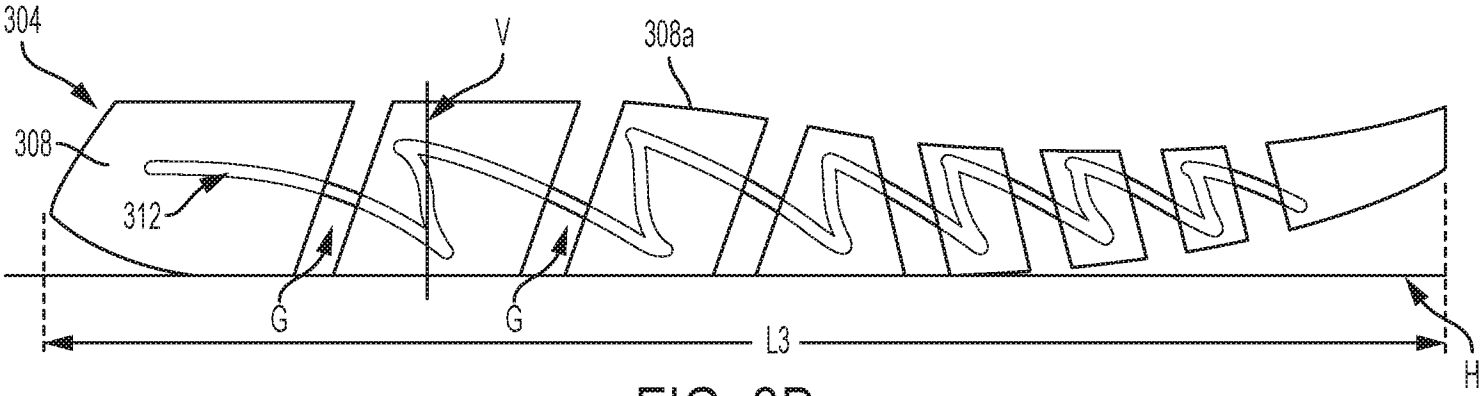
Figure 3C:
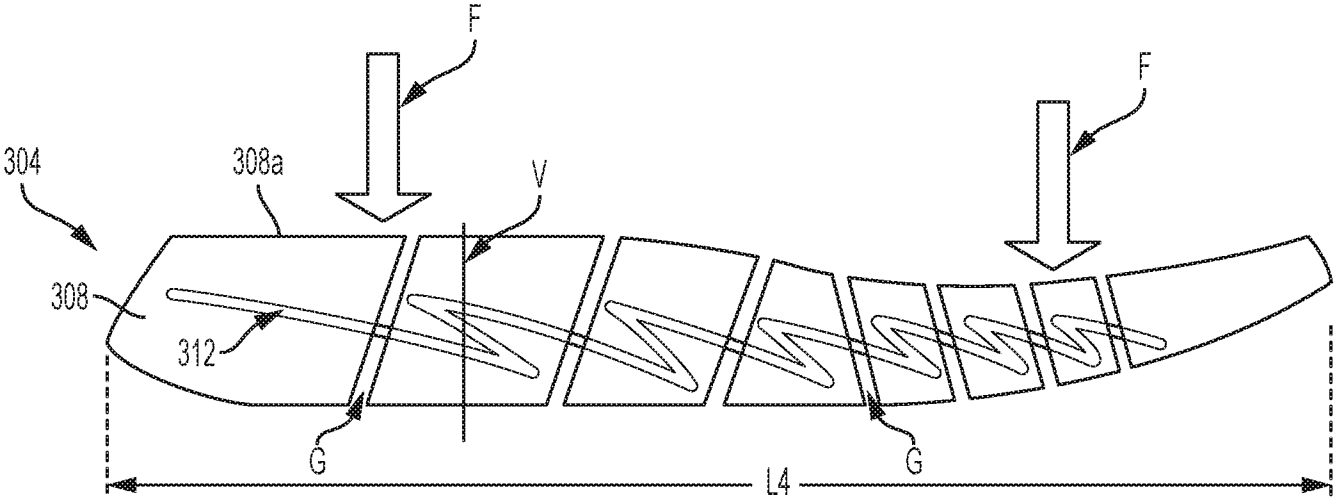

FIGS. 3A-3C illustrate an example foot support component 304 in accordance with this disclosure in which forces applied to the flexible support component 312 cause the flexible support component (and optionally components with which it is engaged) to decrease in dimensional size (e.g., a longitudinal dimension) and/or to apply a compressive force to the plantar support component 308, a footwear upper, and/or other component of the footwear or foot-receiving device structure. FIGS. 3A-3C further illustrate that wave shaped portions in accordance with at least some examples of this disclosure may have different shapes from the more conventional forward propagating wave shapes shown in FIGS. 1A-2C. More specifically, in the example waveform of FIG. 3A, as the wave propagates in one direction (e.g., the left-to-right direction in FIG. 3A), the wave trough peak of one wave is located further to the right than the wave crest peak of the next wave. In other words, when oriented on a horizontal surface, the waveform overlaps itself in the vertical direction. Note how a vertical line or plane V intersects the waveform at multiple, vertically spaced locations in FIGS. 3A-3C. Accordingly, in this example structure, a line or plane perpendicular to the waveform propagation direction will intersect the waveform at multiple, spaced locations along that perpendicular line or plane and/or moving along the waveform repeatedly moves forward and backward in the wave propagation direction, optionally in a zig-zag like pattern.

In use, when the example sole structure 304 of FIG. 3B is exposed to a force F (e.g., an impact force compressing the sole structure 304 from a user landing a step or jump), this will cause areas of the wave shaped portion of the flexible support member 312 exposed to the force to: (a) flatten (e.g., reduce the peak-to-peak amplitude) and/or (b) fold up on itself. FIG. 3B diagrammatically shows the foot support member 304 before a force is applied to it (e.g., with the wearer's foot in the air, off a contact surface; standing free, with no wearer; etc.). Then when exposed to a sufficient force F, as shown in FIG. 3C, flexing of the flexible support member 312 causes the sole member 304 to decrease in overall length (from L3 to L4) (also shown by decreased longitudinal dimensions of the gaps G in the example sole structure 304). When the force F is adequately released or relaxed, the flexible support member 312 (and the remainder of the sole structure 304) will then return (or at least substantially return) to its original size, shape, and dimensions (e.g., back to the form shown in FIG. 3B) due to the flexibility and resilient nature of the flexible support member 112. If desired, foam and/or other material (e.g., material forming the plantar support member 308) may limit the extent of folding of the flexible support member 312 upon itself. Again, the magnitude of the force F may impact the degree to which the flexible support member 312 changes shape (e.g., flattens out or contracts together), e.g., on a landing-by-landing basis. Therefore, when walking, a first type of response/property may be felt by the wearer, but a substantially different response/property may be felt by the wearer if he/she begins to jog, run, sprint, jump, etc. The response/feel may change back to substantially the original response/feel as the wearer again begins walking. These changes in response/feel properties occur simply as a natural response to the contact force of the landing. No changes to the sole/support are required other than the change in impact force. Changes in response and/or feel properties may take place on a step-by-step and/or action-by-action basis.

While FIGS. 3B and 3C show application of a uniform vertical force F at all locations on the plantar support surface 308*a*, this is not a requirement. Rather, individual areas of the flexible support member 312 can flex independently, depending on the locations of the applied force (e.g., as described above in conjunction with FIGS. 2B and 2C).

Flexing of the wave shaped portion of the flexible support member 312 of this example structure also can provide various functions. First, the flexibility can help attenuate ground reaction forces (e.g., from landing the step or jump, from pushing off for a step or jump, etc.) as the applied forces are absorbed by the flexing support member 312 (thereby providing a softer "feel" on the landing and/or push off).

Second, decreasing the dimensions of the sole member 304 can have the effect of applying a compressive force to a foam or other midsole member 308 with which the flexible support member 312 is engaged. This compressive action may have the effect of increasing a firmness (or density) of the compressed foam material, at least at localized areas, which can provide a firmer, more stable foam material. The firmer and more stable foam material at localized areas, such as in the forefoot area beneath the metatarsal heads and toes, may help provide a more solid and stable base for the toe-off phase of a step cycle and/or for initiating a jump.

Accordingly, depending on the desired characteristics of the overall foot support member 304, article of footwear, and/or other foot-receiving device, others components of a foot support member 304, article of footwear, and/or other foot-receiving device may include structures or properties to: (a) accommodate the forces and/or dimensional changes induced in the wave shaped portion of the flexible support member 312 (e.g., to compress or stretch relatively freely with the flexible support member 312), (b) resist these forces and/or dimensional changes (e.g., to absorb the forces applied by the flexible support member 312), and/or (c) partially resist and partially accommodate these forces and/or dimensional changes (e.g., to stretch or compress to a limited extent). As one more specific example, if desired, the flexible support member 312 may be used in combination with a polymer foam midsole material that is sufficiently flexible and/or compressible so as to substantially change dimensions along with the flexible support member 312. As another example, the sole member 304 may be engaged with a footwear upper or other footwear part having a strobel member (e.g., a component closing off the bottom of the upper (and/or forming a bottom surface of the upper) and engaged with the top surface 308*a* of the plantar support component 308) that is sufficiently pliable and compressible so as to accommodate a desired degree of dimensional change (if any) for the foot-receiving chamber of the upper (and thus allow the foot-receiving chamber of the upper to substantially change size along with the sole member 304).

Figure 4A:
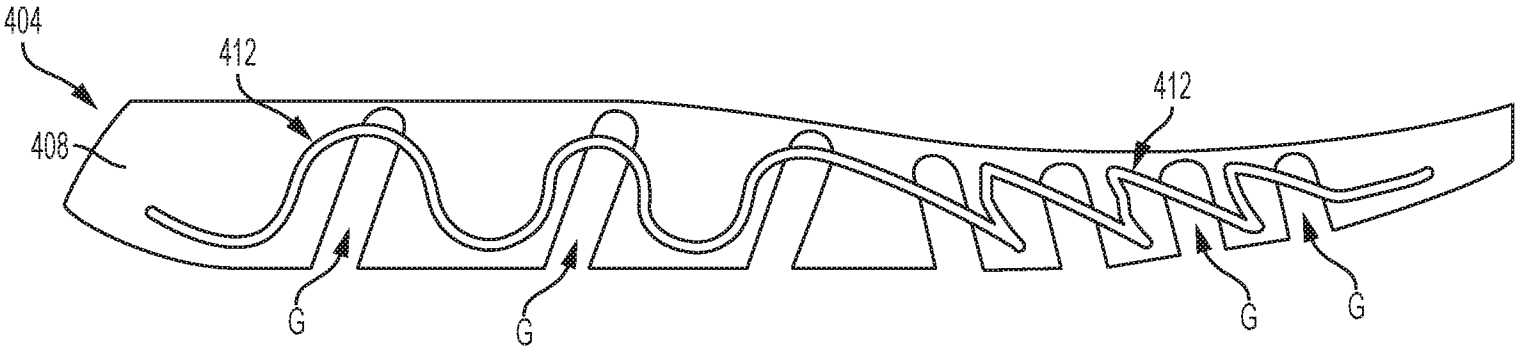
FIGS. 4A and 4B, which illustrate various features of example wave shaped portions of flexible support members that may be used in dynamically transformative support components in accordance with some aspects of this disclosure.
Figure 4B:
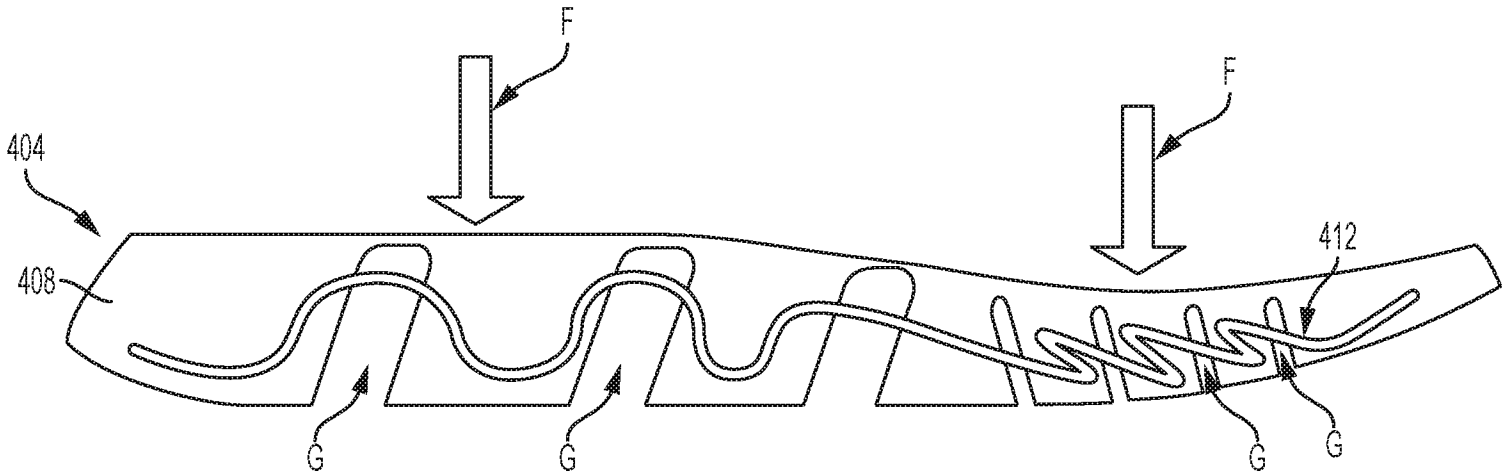

FIGS. 4A and 4B illustrate another example sole structure 404 that includes a foam midsole component 408 and a wave shaped flexible support member 412 that combines features from the examples of FIGS. 2A-3C. More specifically, as shown in FIGS. 4A and 4B, at least the rear heel area of this flexible support member 412 (and optionally at least some of the arch area) includes a wave shaped portion like that of FIGS. 2A-2C (e.g., in which the wave shaped portion has no overlapping areas in a direction perpendicular to the wave propagation direction). Thus, at least the heel area of this sole structure 404 would expand and increase in dimensions under an applied force (e.g., as illustrated in FIGS. 4A and 4B and in a manner as described above in conjunction with FIGS. 2B and 2C). In the arch area and/or forefoot area, however, the wave shaped portion of the flexible support member 412 morphs into a wave shaped portion like that of FIGS. 3A-3C (e.g., in which the wave shaped portion has overlapping areas in a direction perpendicular to the wave propagation direction) that extends in this manner substantially through the forefoot area. Thus, at least the forefoot area of this example sole structure 404 would contract and decrease in dimensions under an applied force (e.g., as illustrated in FIGS. 4A and 4B and in a manner as described above in conjunction with FIGS. 3B and 3C).

This example foot support structure 404 is well suited for athletic shoes (e.g., shoes for activities that include substantial running, jumping, etc.). More specifically, the heel area expands under an applied force F and thus provides good impact force attenuation and a comfortable feel when the bulk of an impact force F is absorbed, e.g., when landing a step or jump. Note the expanding size of the heel gaps G in FIG. 4B as compared to FIG. 4A. The forefoot area, on the other hand, compresses under an applied force F, e.g., later in the step cycle and/or when initiating a step or jump as the weight rolls to the forefoot area, to provide a solid and stable base under the toes and metatarsal heads for push off (particularly at the lateral forefoot side area). Note the contracting size of the forefoot gaps G in FIG. 4B as compared to FIG. 4A. This contracting action may have the effect of applying a compressive force to the foam in the forefoot area and effectively increasing the foam density under the foot "push off" area.

FIGS. 1A-4B illustrate examples of this disclosure in which a single flexible support member 112, 312, 412 is provided with the foot support members 104, 304, 404. Other options are possible. For example, if desired, multiple flexible support members with wave shaped portions may be provided in a single foot support member so that various areas of the foot support member can be tuned to react to an impact force in a desired manner. As some more specific examples, rather than a single flexible support member 412 as shown in FIGS. 4A and 4B, separate flexible support members may be provided in the heel and forefoot areas (e.g., with a gap or discontinuity between them, e.g., in the arch area), wherein the flexible support members have the different heel and forefoot shape characteristics shown in FIGS. 4A and 4B. As another example, if desired, separate flexible support members may be arranged side-by-side in the medial side-to-lateral side direction (e.g., so that one flexible support member supports the medial side of the foot and a separate flexible support member supports the lateral side of the foot). As yet another example, if desired, some example foot support members may include a single heel area flexible support member (with its corresponding wave shaped portion) used in combination with a medial side forefoot flexible support member (with its corresponding wave shaped portion) and a separate lateral side forefoot flexible support member (with its corresponding wave shaped portion). In this example structure, at least three separate flexible support members are provided with wave shaped portions tuned to the desired characteristics for that localized area.

As still other options, the wave shaped portion of the flexible support members of FIGS. 1A-4B need not extend completely from the heel to the toe areas of the foot support member and/or completely from the lateral side edge to the medial side edge of the foot support member. Rather, if desired, the wave shaped portion (and indeed the entire flexible support member) may be located so as to support less than all of the plantar surface of a wearer's foot. As some more specific examples, flexible support members in accordance with examples of this disclosure may be provided only in the heel area or only in the forefoot area of a foot support member. Optionally, if desired, flexible support members could be provided only on a lateral side and/or only on a medial side of some areas of a foot support member (e.g., on the lateral side of the heel area, on the medial side of the forefoot area, etc.).

The size and dimensional features of the flexible support member 112, 312, 412 and the wave shaped portion thereof may vary significantly. For example, the rigid (but flexible) plate making up the wave shaped portion may have a thickness (i.e., a dimension directly from one surface of the component to its opposite surface) within a range of 0.5 to 10 mm, and in some examples, from 1 to 8 mm, from 1 to 5 mm, and/or less than 4 mm. As some additional potential features, when not flexing under weight of a wearer (e.g., as shown in FIGS. 2B, 3B, and 4A), a peak-to-peak amplitude dimension of an adjacent wave trough and wave crest pair (see FIGS. 2A and 3A) in the wave shaped portion may be from 2 to 100 times a maximum thickness dimension of the rigid plate making up that adjacent wave trough and wave crest pair, and in some examples, this ratio may be within the range of 3 to 80 times, 4 to 50 times, and 5 to 40 times. As some example absolute dimensions, when not flexing under weight of a wearer, at least some areas of the wave shaped portion of a flexible support member 112, 312, 412 may have a peak-to-peak amplitude dimension of an adjacent wave trough and wave crest pair of at least 5 mm, and in some examples at least 8 mm, or even at least 12 mm. This peak-to-peak amplitude dimension may be within a range of 5 to 50 mm, and in some examples, from 8 to 40 mm, and from 10 to 35 mm.

Flexion of the wave shaped portions of flexible support members 112, 312, and/or 412 from an unloaded condition (e.g., FIGS. 2B, 3B, and 4A, with no wearer foot in the shoe) to a loaded condition (e.g., FIGS. 2C, 3C, and 4B, when a wearer is landing a step or jump) may change the peak-to-peak amplitude of the flexible support members by any desired amount. As some more specific examples, this change (decrease) in peak-to-peak amplitude under normal human foot wear conditions may be within a range of 3 mm to 35 mm, and in some examples, within a range of 5 mm to 30 mm or a range of 7.5 mm to 25 mm. For measurement purposes, "normal human foot wear conditions" as used herein refers to wear conditions to which a foot support member is exposed when the shoe or foot-receiving device is used in its intended manner by a male wearer weighing 180 lbs. (in landing a step or jump). As for relative change in peak-to-peak amplitude between an unloaded condition (with no wearer in the shoe) and a loaded condition (e.g., when a user lands a step or jump) under normal human foot wear conditions, the wave shaped portions of the flexible support members according to at least some examples of this disclosure may satisfy any of the following formulae:

$$H_{PTP,\ Loaded}=0.3H_{PTP,\ Unloaded} \text{ to } 0.94H_{PTP,\ Unloaded}$$

$$H_{PTP,\ Loaded}=0.4H_{PTP,\ Unloaded} \text{ to } 0.9H_{PTP,\ Unloaded}$$

$$H_{PTP,\ Loaded}=0.5H_{PTP,\ Unloaded} \text{ to } 0.85H_{PTP,\ Unloaded},$$

wherein "$H_{PTP,\ Unloaded}$" represents the peak-to-peak amplitude of the wave shaped portion of a flexible support member in an unloaded condition and "$H_{PTP,\ Loaded}$" represents the peak-to-peak amplitude of the same wave shaped portion of the flexible support member in a loaded condition.

Additionally, flexion of the wave shaped portions of flexible support members 112 from an unloaded condition (with no wearer in the shoe) to a loaded condition (e.g., when a user lands a step or jump) under normal human foot wear conditions may change the wave period or wavelength by any desired amount without departing from this disclosure. As some more specific examples, this change (increase) in period under normal human foot wear conditions may be within a range of 2 mm to 25 mm, and in some examples, within a range of 3 mm to 20 mm or a range of 4 mm to 15 mm. As for relative change in period between an unloaded condition (with no wearer in the shoe) and a loaded condition (e.g., when a user lands a step or jump) under normal human foot wear conditions, the wave shaped portion of the flexible support members 112 according to at least some examples of this disclosure may satisfy any of the following formulae:

$$P_{Loaded}=1.05P_{Unloaded} \text{ to } 1.25P_{Unloaded}$$

$$P_{Loaded}=1.075P_{Unloaded} \text{ to } 1.2P_{Unloaded}$$

$$P_{Loaded}=1.1P_{Unloaded} \text{ to } 1.175P_{Unloaded},$$

wherein "$P_{Unloaded}$" represents the period of the wave shaped portion of the flexible support member 112 in an unloaded condition and "$P_{Loaded}$" represents the period of the same wave shaped portion of the flexible support member 112 in a loaded condition.

FIGS. 1A through 4B illustrate various example structures in which the peaks of the wave crests and wave troughs are arranged to extend substantially in the sole structure medial side-to-lateral side direction. Other arrangements are possible. For example, FIGS. 5A-5E illustrate an example sole structure 504 according to this disclosure in which the peaks of the wave crests and wave troughs are arranged to extend substantially in a heel-to-toe direction. The example of FIGS. 5A-5E also illustrates a foot support member 504 having a wave shaped flexible support member arranged in a relatively targeted area of the support member 504 structure.

Figure 5B:
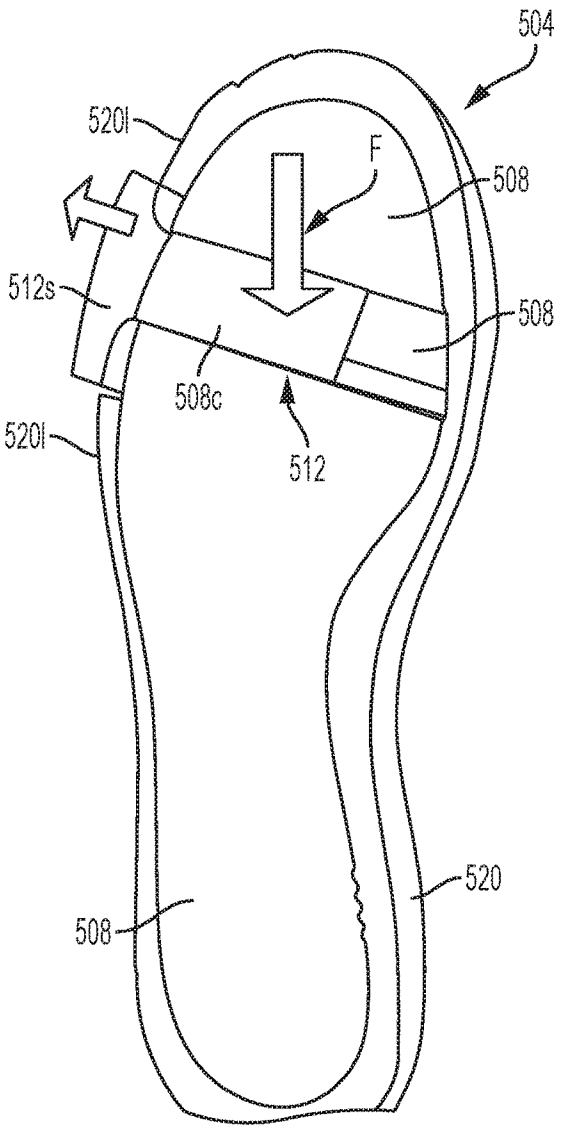
FIGS. 5A through 5E, which illustrate various views of another example foot support member, e.g., in the form of an "outrigger" type structure, that includes a dynamically transformative support component in accordance with some aspects of this disclosure.
Figure 5A:
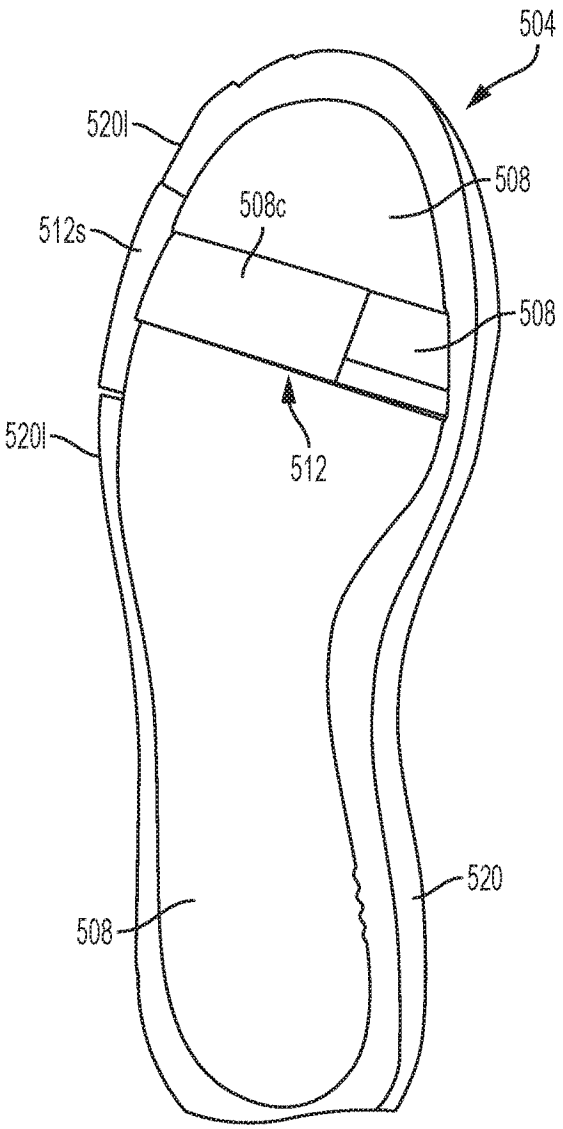
Figure 5C:
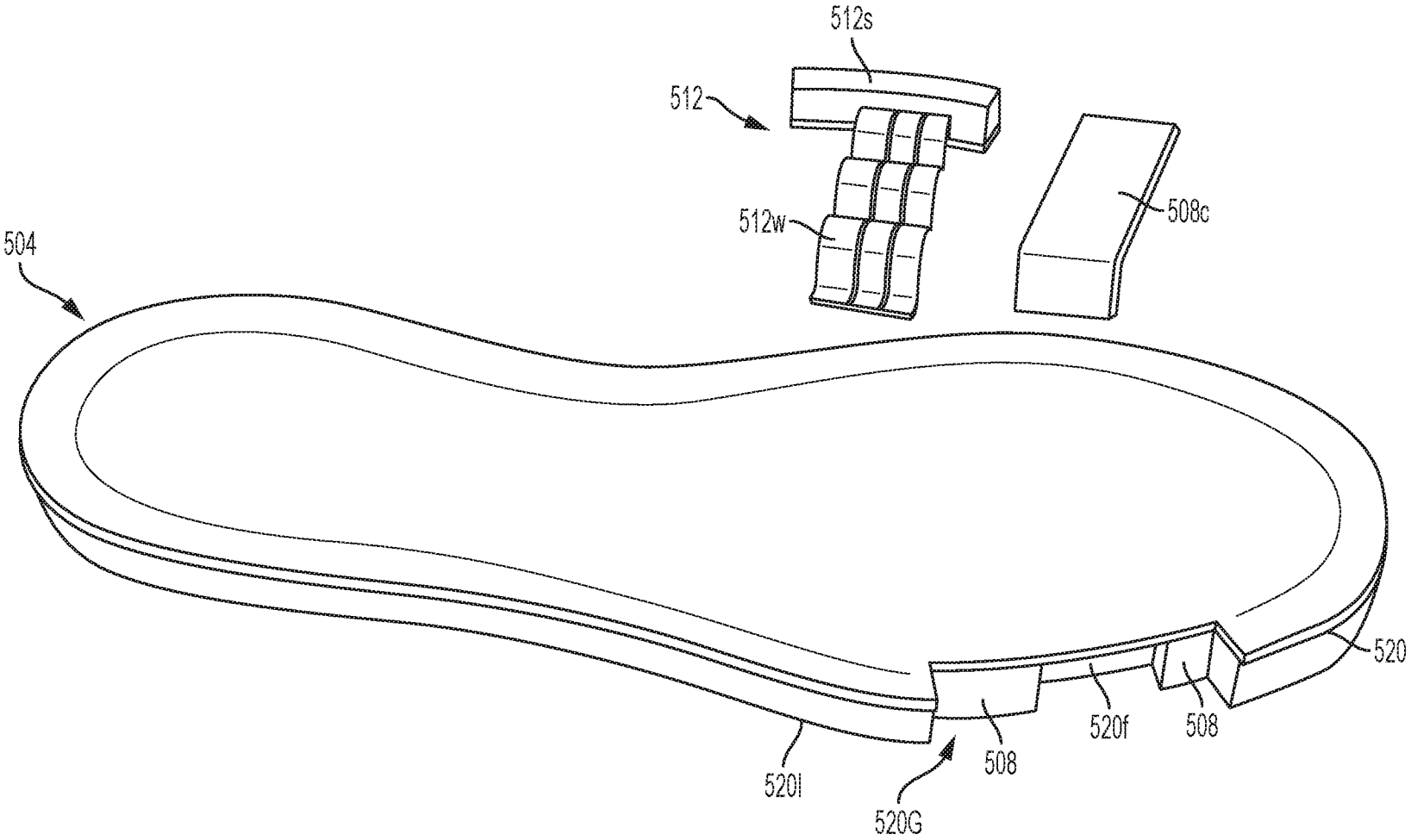
Figure 5D:
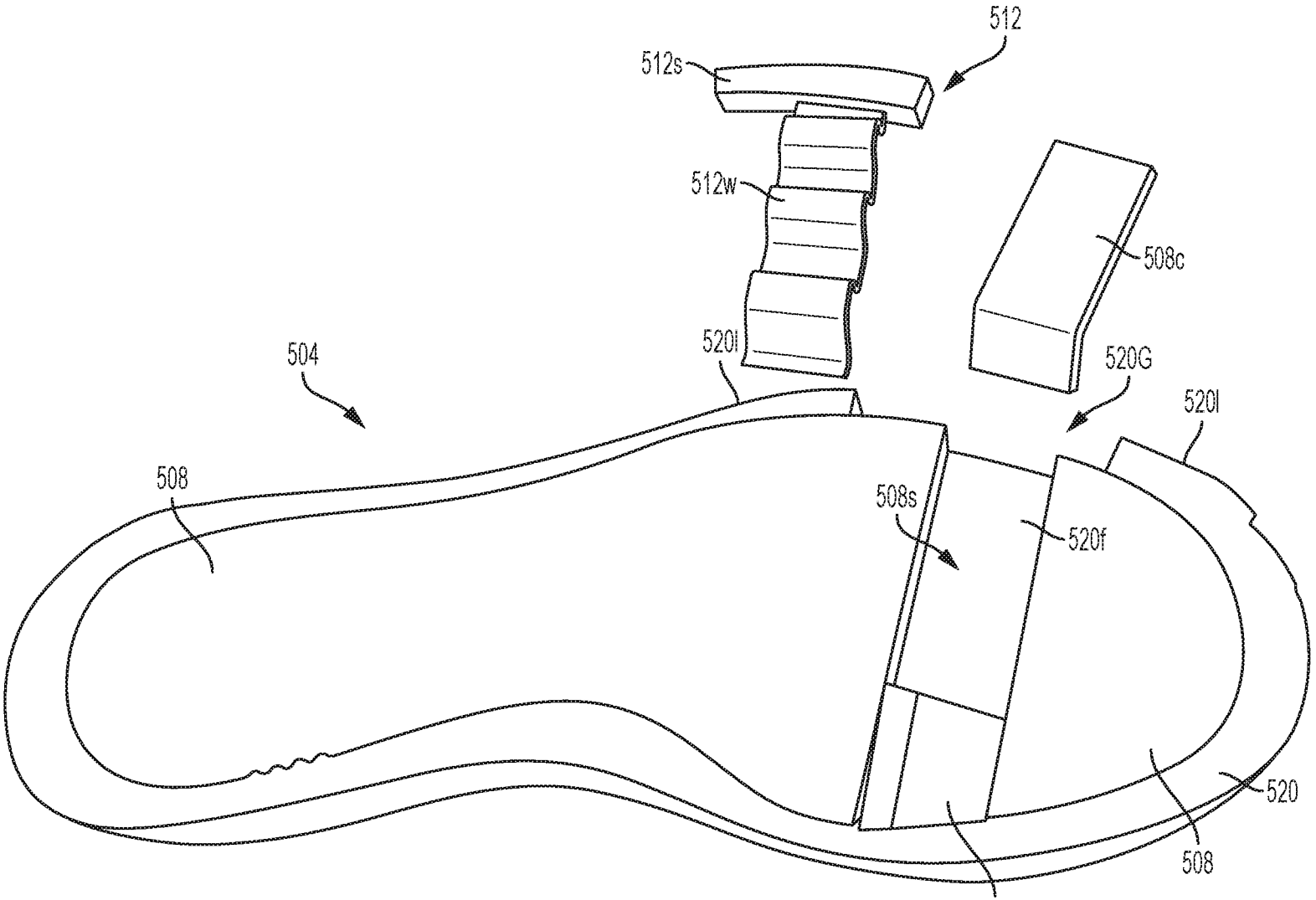

FIG. 5A provides a top view of this example foot support member 504 in an unloaded (unflexed) condition; FIG. 5B provides a top view of this example foot support member 504 in a loaded (flexed) condition under an applied force F; FIG. 5C provides a bottom, exploded view of the foot support member 504; FIG. 5D provides a top, exploded view of the foot support member 504; and FIG. 5E provides a partially assembled view of the foot support member 504 (FIGS. 5A and 5B show the fully assembled foot support member 504).

FIGS. 5A-5E illustrate the foot support member 504 (e.g., a sole structure for an article of footwear) having one or more midsole components 508 as a plantar support component (e.g., which may include one or more of a polymer foam material, a fluid-filled bladder, mechanical shock absorbing components, foam type shock absorbing columns, etc., in any desired combination). The midsole component(s) 508 of this example are mounted in an interior volume defined by a cup type outsole component 520. The lateral side wall 5201 in the forefoot area of this example outsole component 520 includes a gap 520G (see, for example, FIGS. 5C and 5D).

The forefoot area of this example foot support member 504 includes a discontinuity in the midsole component 508 for accommodating a flexible support member 512 in accordance with some examples of this disclosure. This example flexible support member 512 includes a wave shaped portion 512*w*, and a cover element 508*c* is provided as part of the plantar support component 508 of this structure. One free end of the wave shaped portion 512*w* includes a sole portion 512*s* engaged with it. This sole portion 512*s* provides a portion of a side wall and bottom (e.g., a ground contacting portion) of the overall sole structure and fits into the gap 520G provided in outsole component 520. The wave shaped portion 512*w* of this example structure 504 has a wave structure like that described above in conjunction with FIGS. 2A-2C (e.g., a construction that flattens and expands under an applied force, has no overlapping areas in a direction perpendicular to the wave propagation direction, etc.).

Figure 5E:
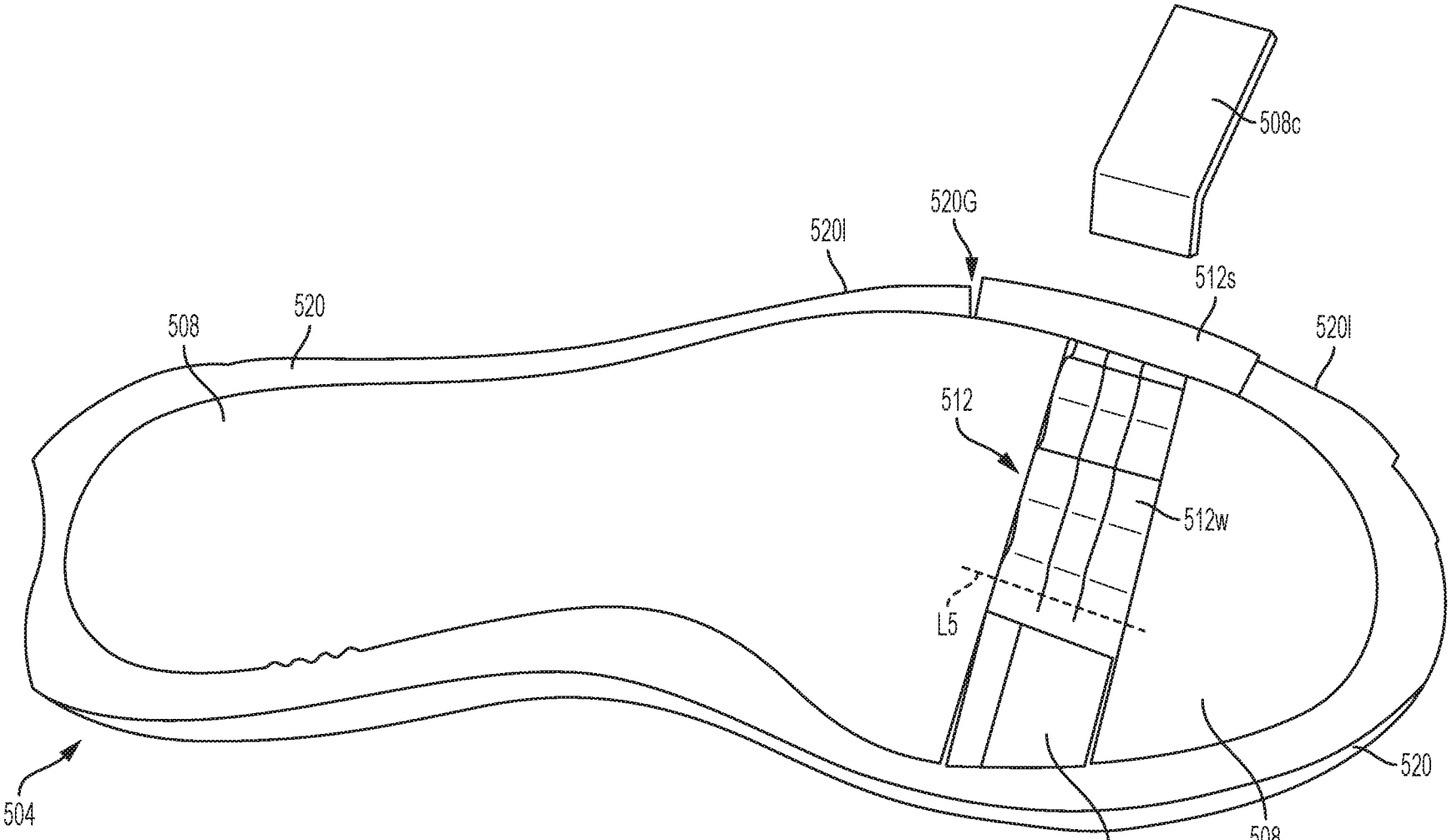

This example foot support component 504 is constructed in the manner shown in FIGS. 5C-5E. First, the outsole component 520 (as one or more component parts) and the midsole component(s) 508 are made in a conventional manner and may be engaged with one another (e.g., using cements or adhesives). The midsole component(s) 508 are mounted with the outsole component 520 in a manner so as to leave a space 508*s* for receiving the flexible support member 512. If necessary or desired, the bottom surface of the space 508*s* (adjacent a top surface of the outsole component 520) may be fitted with a hard, rigid plate 520*f* (e.g., if the outsole component 520 is made from a material that is more flexible or compliant than desired for the action described in more detail below). If desired, this plate 520*f* may have (or may be treated to have) a reduced coefficient of friction with respect to the material of the wave shaped portion 512*w* of the flexible support member 512 so as to accommodate flexing and flattening of the wave shaped portion 512*w*, as will be described in more detail below.

Next, the wave shaped portion 512*w* of the flexible support member 512 is mounted in the space 508*s* such that the sole portion 512*s* of the flexible support member 512 is provided to close the gap 520G in the sidewall 5201 of the outsole component 520. See FIG. 5E. The wave shaped portion 512*w* may be engaged with the other foot support member 504 component(s) (e.g., the midsole 508, the outsole 520, etc.) in any desired manner so as to accommodate the action described in more detail below, such as by adhesives or cements, by mechanical connectors, etc., provided at the medial edge of the wave shaped portion 512*w*. As shown in FIG. 5E, in this example structure 504, the wave shaped portion 512*w* of the flexible support member 512 extends from a central or medial side forefoot region of the foot support member 504 toward (and to) a lateral side edge of the foot support member 504. The peaks of the wave crests and wave troughs of the wave shaped portion 512*w* are arranged to extend in substantially a heel-to-toe direction of the sole structure, and more precisely, along a line L5 that extends in a forward medial-to-rear lateral direction. A cover element 508*c* may be mounted over the wave shaped portion 512*w* of the flexible support member 512, as shown in FIGS. 5A and 5B, to provide a more comfortable surface for engaging and supporting a wearer's foot. The cover element 508*c* may be flexible or stretchable (e.g., a foam material), may have a relatively low coefficient of friction with respect to the wave shaped portion 512*w* (e.g., if provided as a harder plate type structure so that the wave shaped portion 512*w* can slide along and beneath it), and/or may otherwise be mounted in the foot support member structure 504 in a manner so as to accommodate flexing of the wave shaped portion 512*w* in a manner described in more detail below.

This example sole structure 504 can be particularly suited for footwear (e.g., athletic footwear) used in activities where rapid turns and/or cutting actions take place. During such rapid turns and/or cutting actions, a person typically will step down hard on the medial forefoot side of the foot (e.g., with the force applied at the first and optionally second metatarsal head areas (the medial forefoot area) of the foot). As the rapid turn and/or cutting action continues, the weight (force) of the person begins to roll toward the lateral side of the foot, as the person begins pushing off in the opposite direction. As the weight/force F rolls toward the lateral side, it will cause the wave shaped portion 512*w* of the flexible support member 512 to flex (flatten) out and thereby expand its dimensions (e.g., by expanding in the wave propagation direction and increasing its wave period). This flexing/flattening action causes the sole portion 512*s* of the flexible support member 512 to extend laterally outward with respect to a majority of a lateral perimeter edge of the foot support member 504 (e.g., with respect to a majority of the lateral side wall 5201 of the outsole component 520). As the weight continues to shift toward the lateral side, the lateral side of the sole structure 504 will land with the sole portion 512*s* in its extended condition (e.g., as shown in FIG. 5B), thereby providing a wider and more stable base to support the rapid turn or cutting action. As the force is relaxed or removed, the resilient nature of the flexible support member 512 will return the support member 504 to (or toward) its original size, shape, and dimensions (e.g., as shown in FIG. 5A).

While not shown in FIGS. 5A-5E, if desired, the openings and gaps in the foot support member 504 can be closed off, e.g., to prevent water or debris from entering the foot-containing chamber of the footwear or foot-receiving device structure. For example, if desired, the sole portion 512*s* of the flexible support member 512 may be engaged with the lateral side wall 5201 and/or the bottom surface of the outsole member 520 by a flexible material (e.g., an accordion type joint, a stretchable material, etc.). As another example, an interior surface of the foot support member 508 and/or another component may include a waterproof membrane to prevent water from entering the foot-containing chamber. Other structures may be used for this purpose.

The wave shaped portion 512*w* of flexible support member 512 may have the size and/or dimensional features described above for flexible support members 112, 312, 412. As some more specific examples, the rigid (but flexible) plate making up the wave shaped portion 512*w* may have a thickness (i.e., a dimension directly from one surface of the component to its opposite surface) within a range of 0.25 to 5 mm, and in some examples, from 0.5 to 4 mm, from 0.5 to 3 mm, and/or less than 3 mm. As some additional potential features, when not flexing under weight of a wearer, a peak-to-peak amplitude dimension of an adjacent wave trough and wave crest pair in the wave shaped portion may be from 2 to 100 times a maximum thickness dimension of the rigid plate making up that adjacent wave trough and wave crest pair, and in some examples, this ratio may be within the range of 3 to 80 times, 4 to 50 times, and 5 to 40 times. As some example absolute dimensions, when not flexing under weight of a wearer, at least some areas of the wave shaped portion of a flexible support member 512*w* may have a peak-to-peak amplitude dimension of an adjacent wave trough and wave crest pair of at least 5 mm, and in some examples at least 8 mm, or even at least 10 mm. This peak-to-peak amplitude dimension may be within a range of 4 to 50 mm, and in some examples, from 5 to 40 mm, and from 6 to 35 mm.

Flexion of the wave shaped portion 512*w* of flexible support member 512 from an unloaded condition (e.g., FIG. 5A, with no wearer foot in the shoe) to a loaded condition (e.g., FIG. 5B, when a wearer is landing a step or jump) may change the peak-to-peak amplitude of the wave shaped portion 512*w* by any desired amount without departing from this disclosure. As some more specific examples, this change (decrease) in peak-to-peak amplitude under normal human foot wear conditions may be within a range of 2 mm to 35 mm, and in some examples, within a range of 3 mm to 30 mm or a range of 5 mm to 25 mm. As for relative change in peak-to-peak amplitude between an unloaded condition (with no wearer in the shoe) and a loaded condition (e.g., when a user lands a step or jump) under normal human foot wear conditions, the wave shaped portion 512*w* of the flexible support member 512 according to at least some examples of this disclosure may satisfy any of the following formulae:

$$H_{PTP,\ Loaded}=0.3H_{PTP,\ Unloaded} \text{ to } 0.96H_{PTP,\ Unloaded}$$

$$H_{PTP,\ Loaded}=0.4H_{PTP,\ Unloaded} \text{ to } 0.925H_{PTP,\ Unloaded}$$

$$H_{PTP,\ Loaded}=0.5H_{PTP,\ Unloaded} \text{ to } 0.9H_{PTP,\ Unloaded},$$

wherein "$H_{PTP,\ Unloaded}$" represents the peak-to-peak amplitude of the wave shaped portion 512*w* of the flexible support member 512 in an unloaded condition and "$H_{PTP,\ Loaded}$" represents the peak-to-peak amplitude of the same wave shaped portion 512*w* of the flexible support member 512 in a loaded condition.

Additionally, flexion of the wave shaped portion 512*w* of flexible support member 512 from an unloaded condition (with no wearer in the shoe) to a loaded condition (e.g., when a user lands a step or jump) under normal human foot wear conditions may change the wave period or wavelength by any desired amount without departing from this disclosure. As some more specific examples, this change (increase) in period under normal human foot wear conditions may be within a range of 1 mm to 25 mm, and in some examples, within a range of 2 mm to 20 mm or a range of 3 mm to 15 mm. As for relative change in period between an unloaded condition (with no wearer in the shoe) and a loaded condition (e.g., when a user lands a step or jump) under normal human foot wear conditions, the wave shaped portion 512*w* of the flexible support member 512 according to at least some examples of this disclosure may satisfy any of the following formulae:

$$P_{Loaded}=1.05P_{Unloaded} \text{ to } 1.35P_{Unloaded}$$

$$P_{Loaded}=1.075P_{Unloaded} \text{ to } 1.3P_{Unloaded}$$

$$P_{Loaded}=1.1P_{Unloaded} \text{ to } 1.25P_{Unloaded},$$

wherein "$P_{Unloaded}$" represents the period of the wave shaped portion 512*w* of the flexible support member 512 in an unloaded condition and "$P_{Loaded}$" represents the period of the same wave shaped portion 512*w* of the flexible support member 512 in a loaded condition.

FIGS. 6A-6E illustrate another example foot support member 604 in accordance with some examples of this disclosure. The wave shaped portion of the flexible support member in this illustrated example is provided in a heel region of the foot support member, and the peaks of the wave crests and wave troughs of the wave shaped portion are oriented in substantially the heel-to-toe direction in this example structure. Although illustrated for use in the heel area, this type of foot support member 604 could be provided in other areas of a foot-receiving device as well.

Figure 6A:
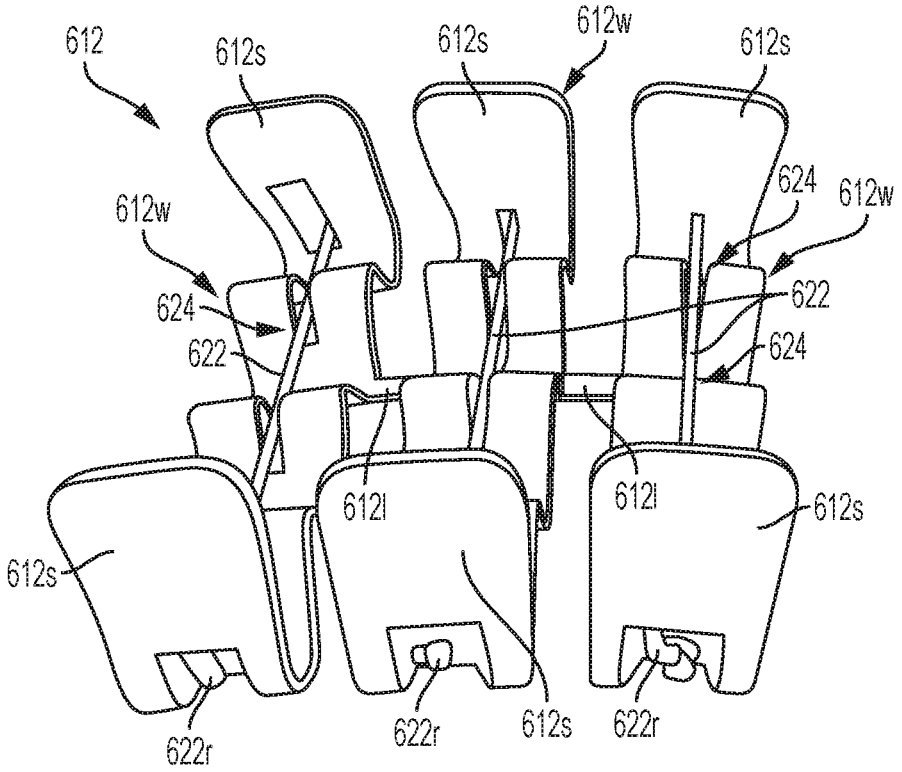
FIGS. 6A through 6E, which illustrate various views of another example foot support member that includes a dynamically transformative support component in accordance with some aspects of this disclosure.
Figure 6B:
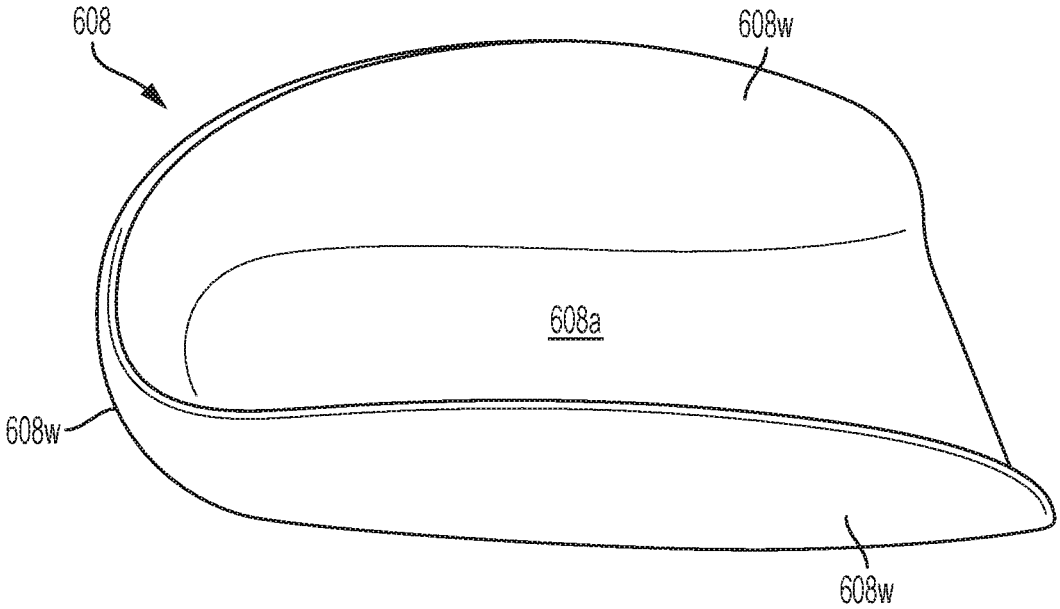

As shown in FIGS. 6A-6E, this foot support member 604 includes two main parts: (a) the flexible support member 612 including three wave shaped portions 612*w* (FIG. 6A); and (b) a plantar (heel) support component 608 (FIG. 6B). The plantar support component 608 in this example includes an upper surface 608*a* for supporting a user's heel and a raised sidewall 608*w* that forms a "heel cup" type structure. The illustrated sidewall 608*w* in this example extends continuously around the rear heel and along the medial and lateral sides of the heel support component 608, although it could have breaks in it, if desired. The plantar support member 608 of this example may be made from a rigid, plate like material (e.g., materials of the types described above for the flexible support member 612), a more compliant foam or other flexible material (e.g., a TPU), or any other desired material.

If desired, the plantar support member 608 also could have sidewalls that perform functions of conventional heel counter type structures.

While the three wave shaped portions 612*w* of the flexible support member 612 are shown interconnected to form a single part in these figures (connected along the center wave crest peaks by links 6121), a single wave shaped portion 612*w* and/or two or more completely separated wave shaped portions 612*w* could be used, if desired, without departing from this disclosure. The wave shaped portions 612*w* (and indeed the entire flexible support member 612) may be made from rigid but flexible materials, such as plastic materials of the types described above with respect to flexible support member 112. Furthermore, while other options are possible, the wave shaped portions 612*w* of this example have wave structures like that described above in conjunction with FIGS. 2A-2C (e.g., a waveform construction that flattens and expands under an applied force, has no overlapping areas in a direction perpendicular to the wave propagation direction, etc.).

FIGS. 6A and 6C-6E show gaps (e.g., longitudinal gaps) between the individual wave shaped portions 612*w* of the flexible support member 612 (except along the connection links 6121). These gaps may have any desired size without departing from this disclosure, provided the wave shaped portions 612*w* do not interfere with one another during the flexion action described herein. As some more specific examples, with the flexible support member 612 in an unloaded condition, adjacent wave shaped portions may be separated from one another by at least 5 mm, and in some examples, within a range of 5 mm to 20 mm or within a range of 7.5 mm to 15 mm. While this gap measurement may be made at any desired location along the wave shaped portion (except at any connecting links 6121, if any), in some examples, separation distances within these ranges may be found at wave trough peaks in adjacent wave shaped portions 612*w*. The wave shaped portions 612*w* of this example flexible support member 612 may have the peak-to-peak amplitude dimensions, wave period dimensions, absolute changes in peak-to-peak amplitude dimensions (comparing an unloaded to loaded condition), absolute changes in wave period dimensions (comparing an unloaded to loaded condition), relative changes in peak-to-peak amplitude dimensions (comparing an unloaded to loaded condition), and relative changes in wave period dimensions (comparing an unloaded to loaded condition) to the various structures described above in conjunction with FIGS. 1A-2C.

Figure 6C:
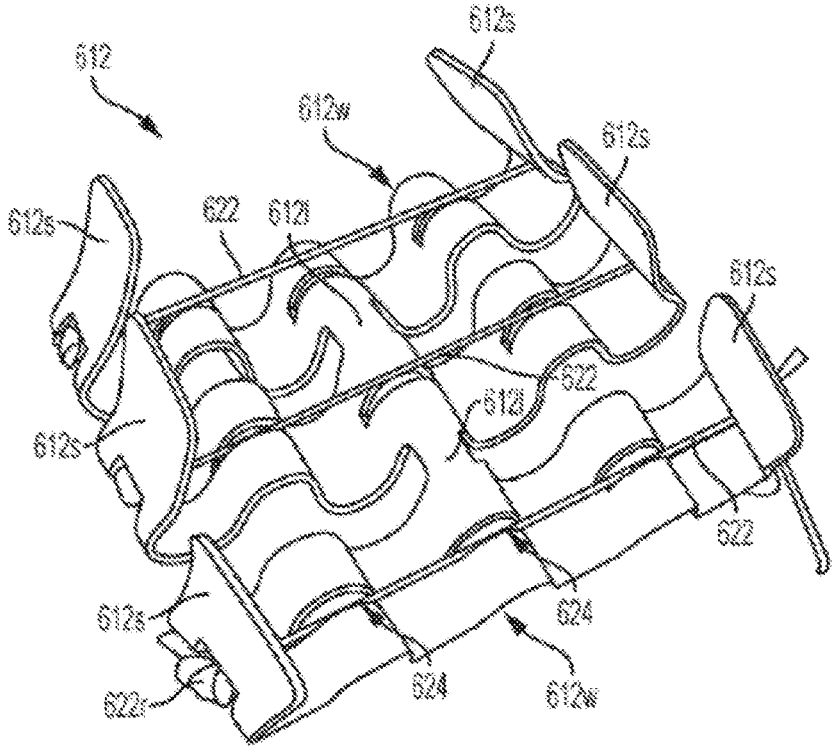
Figure 6D:
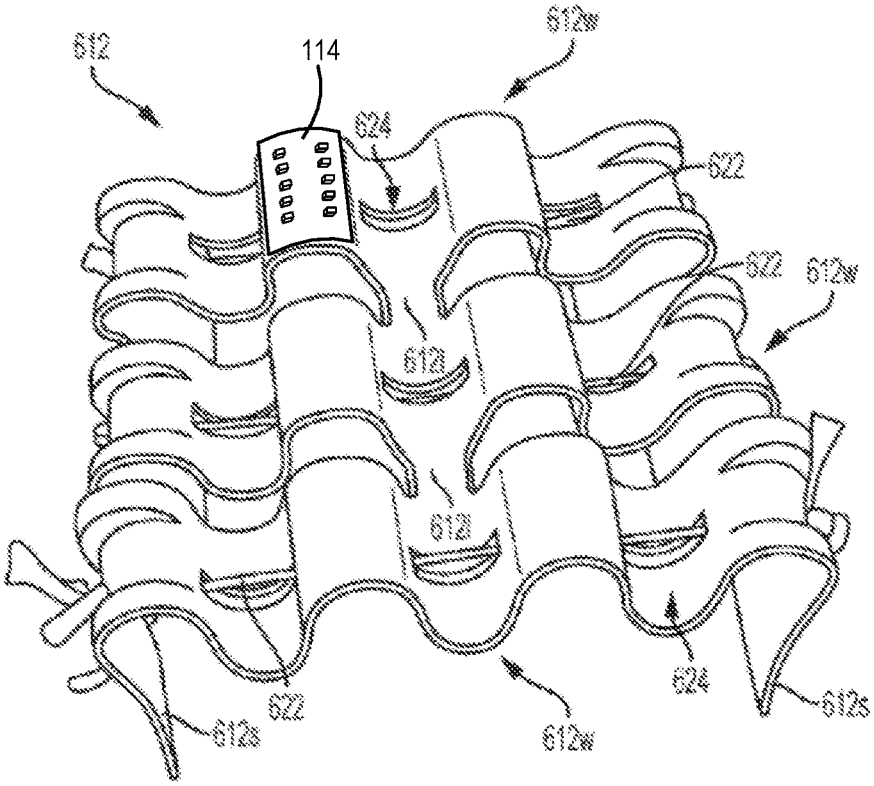
Figure 6E:
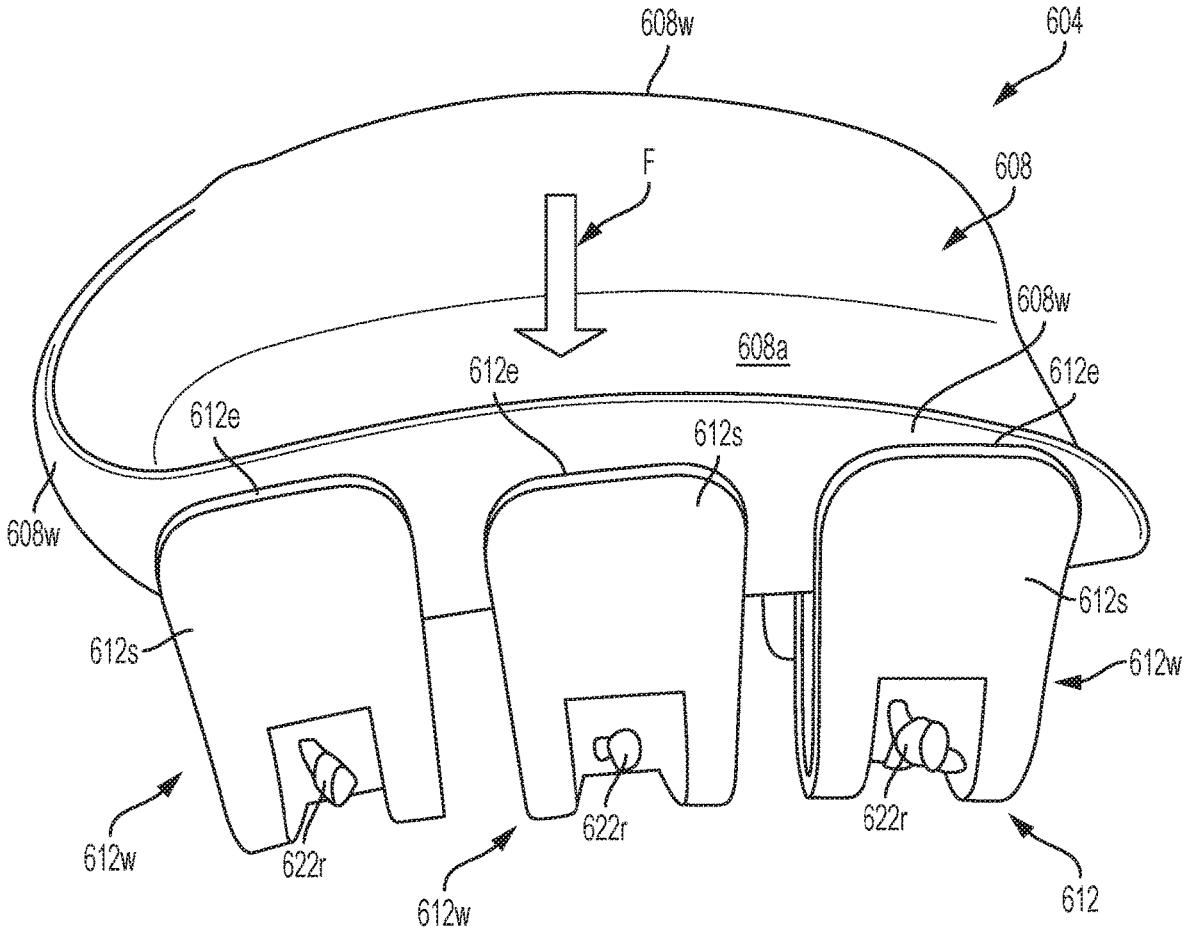

The example flexible support member 612 of FIGS. 6A and 6C-6E includes features not show in the examples of FIGS. 1A-5E. For example, the lateral and medial sides of the wave shaped portions 612*w* in this example extend upward to form raised sidewalls 612*s* that extend above and beyond the peaks of the wave crests. While these figures show an example flexible support member structure 612 in which both the lateral and medial sides of each wave shaped portion 612*w* includes the raised sidewalls 612*s*, other options are possible, such as: raised sidewalls 612*s* located on just a lateral side or just a medial side of one or more wave shaped portion 612*w*; raised sidewalls 612*s* on fewer than every wave shaped portion or on fewer that every wave shaped portion side; raised sidewalls 612*s* that extend upward to different extents or different distances (e.g., not necessarily above the wave crest peaks); etc. As shown in FIG. 6E, the raised sidewalls 612*s* of this example are oriented to wrap around and extend along the exterior surfaces of sidewalls 608*w* of the plantar (heel) support component 608. In this manner, the heel support component 608 rests atop the peaks of the wave crests of the wave shaped portion 612*w* of the flexible support member 612. The peaks of the wave crests and troughs of the flexible support member 612 in this example foot support structure 604 are arranged to extend in a longitudinal (or heel-to-toe) direction of the foot support component 604 and/or the article of footwear or foot-receiving device with which it is used.

Furthermore, as shown in FIGS. 6C and 6D, the portions of wave-shaped portion 612*w* that contact the ground or a bottom support member have a rounded shape. The rounded shape helps translate the force flattening the wave shaped portion 612*w* to other portions of the support, as will become more evident from the discussion below. "Rounded" as used herein in this context means curved. While the arc of the curve may lie along some predetermined shape (e.g., a portion of a circle, ellipse, oval, parabola, etc., this is not a requirement.

The flexible support member 612 of this illustrated example optionally includes additional features, namely, a tensioning element or spring component 622 extending between the first side member (e.g., medial sidewall 612*s*) and the second side member (e.g., lateral sidewall 612*s*). The tensioning element 622 may constitute a substantially unstretchable cable, wire, or filament that attaches to and ties the medial sidewall 612*s* to the lateral sidewall 612*s* and substantially fixes the distance between the two sidewalls 612*s* at these attachment points. (The term "substantially unstretchable" as used herein in this context means an element that stretches less than 5% of its longitudinal length under an applied tensile force of 10 kg.) The tensioning element 622 may be fixed to the sidewalls 612*s* in any desired manner without departing from the disclosure. As one more specific example, the tensioning element 622 may be fixed to the sidewalls 612*s* by passing the free ends of the tensioning element 622 through a hole formed in the sidewalls 612*s* and then applying a retaining element 622*r* (or stopper) to the ends of the tensioning element 622 outside of the sidewalls 612*s*. In this example, the retaining element 622*r* is sized so as to prevent the free end of the tensioning element 622 from slipping back through the sidewall's 612*s* hole. The retaining elements 622*r* may be located so as to keep the tensioning element 622 taut across the wave shaped portion 612*w* even when the wave shaped portion 612*w* is in an unloaded condition, or they may be positioned to provide some slack in the tensioning element 622 in the unloaded condition (e.g., so that the wave shaped portion(s) 612*w* will flatten and expand somewhat under an applied force until the sidewalls 612*s* reach the retaining elements 622*r*). Additionally or alternatively, if desired, element 622 may have some stretchability (e.g., function more as a spring) that would allow some limited stretch under an applied force (e.g., landing a step or jump) but then apply a return force to help return the flexible support member 612 to its original size, shape, and dimensions when the force is sufficiently relaxed or removed and/or to prevent excessive flexion of the flexible support member 612.

As shown in FIGS. 6A, 6B, and 6D, in this illustrated example flexible support member structure 612, at least some portions of the wave crests (especially at the peaks thereof) and/or troughs have a slot 624 formed in them to accommodate the tensioning element 622. In this manner, the ends of the tensioning element 622 can be secured at a location on the sidewalls 612*s* below the level of the crest peaks (at least when the flexible support member 612 is in an unloaded condition).

This example foot support member 604 may operate in the following manner. An impact force F (e.g., from landing a step or jump on plantar support surface 608*a*) causes the wave shaped portions 612*w* to flatten and attempt to expand or splay outward (e.g., increase the length of the waveform period while reducing the peak-to-peak amplitudes of the wave shaped portions 612*w*). The tensioning element or spring component 622, however, limits the ability of the wave shaped portions 612*w* to separate from one another at the sidewall 612*s* attachment locations (i.e., at retaining elements 622*r*). Thus, if exposed to more force than needed to maximize expansion between the sidewalls 612*s*, the sidewalls 612*s* will rotate somewhat about the attachment points (622*r*) on their rounded contacting surfaces under the additional force. This "rotation" causes the upper edges 612*e* of the opposite sidewalls 612*s* (i.e., the lateral sidewall and the corresponding medial sidewall on a wave shaped portion 612*w* connected by a tensioning element or spring component 622) to rotate closer to one another (or pinch together somewhat). This action increases the forces applied by sidewalls 612*s* of the wave shaped portions 612*w* to the sidewalls 608*w* of the heel support member 608, thereby tightening and providing a more secure and solid feel. This tightening action may be relaxed or relieved once the impact force F is sufficiently relaxed or relieved (e.g., due to the resilient nature of the wave shaped portions 612*w*, any spring effect provided with component 622, and/or return of tensioning element 622 to its original length). As shown in the figures, the outer surfaces of the wave-shaped portions 612*w* at the ground contact areas may be rounded to promote the rotational action described above (e.g., provide somewhat of a "cam" type action).

Foot support member 604 may be incorporated into the heel of an article of footwear or other foot-receiving device structure. Additionally, it may be used in combination with other conventional foot support components, e.g., for the heel, arch, and/or forefoot areas, such as conventional arch support plates, foam impact force attenuation materials, fluid-filled bladders, etc. If desired, the bottom surfaces of at least some of the wave shaped portions 612*w* (e.g., the troughs including the trough peak areas) may have outsole, tread, and/or other wear resistant and/or traction enhancing components engaged with and/or formed on them. As one more specific option, if desired, outsole component(s) 114 (only one shown in FIG. 6D, like components 114*b* and/or 114*t* described above) may be provided with foot support member 604 (e.g., at the exterior bottom of the wave shaped portion(s) 612*w* and/or exterior trough areas (including exterior trough peak areas), as shown in FIG. 6D).

III. CONCLUSION

The present technology is disclosed above and in the accompanying drawings with reference to a variety of examples. The purpose served by the disclosure, however, is to provide examples of the various features and concepts related to the technology, not to limit the scope of the invention. Features of one example structure may be provided, used, and/or interchanged in some of the other structures, even though that specific combination of structures and/features is not described. One skilled in the relevant art will recognize that numerous variations and modifications may be made to the structures described above without departing from the scope of the present disclosure, as defined by the appended claims.

What is claimed is:

1. A foot support member, comprising:

a plantar support component for supporting at least a portion of a plantar surface of a wearer's foot, wherein the plantar support component includes a first surface and a second surface opposite the first surface;

a first flexible support member disposed adjacent the second surface of the plantar support component, wherein the first flexible support member includes a first wave shaped portion, wherein the first wave shaped portion is oriented such that first plural wave crests extend toward the first surface of the plantar support component and first plural wave troughs extend away from the first surface of the plantar support component, wherein the first wave shaped portion is formed as a first rigid plate made from a rigid but flexible material capable of flexing under weight of the wearer, and wherein flexing of the first rigid plate under weight of the wearer induces at least one first reaction selected from the group consisting of: (a) causes at least a portion of the first rigid plate to become flatter, (b) causes at least a portion of the first rigid plate to compress together, (c) changes at least one of a longitudinal or transverse dimension of the foot support member, and (d) applies a compressive or tensile force to at least one of the plantar support component or another part of the foot support member;

a second flexible support member disposed adjacent the second surface of the plantar support component, wherein the second flexible support member includes a second wave shaped portion, wherein the second wave shaped portion is oriented such that second plural wave crests extend toward the first surface of the plantar support component and second plural wave troughs extend away from the first surface of the plantar support component, wherein the second wave shaped portion is formed as a second rigid plate made from said rigid but flexible material or another rigid but flexible material capable of flexing under weight of the wearer, wherein flexing of the second rigid plate under weight of the wearer induces at least one second reaction selected from the group consisting of: (a) causes at least a portion of the second rigid plate to become flatter and (b) causes at least a portion of the second rigid plate to compress together; and wherein the first flexible support member and the second flexible support member are joined together as a unitary, one piece construction by a first link extending between a wave crest peak of the first plural wave crests of the first flexible support member and an adjacent wave crest peak of the second plural wave crests of the second flexible support member.

2. The foot support member according to claim 1, further comprising an outsole element located on an opposite side of the first flexible support member from the plantar support component and covering at least a portion of the first plural wave troughs.

3. The foot support member according to claim 1, wherein the first wave shaped portion of the first flexible support member is located in a heel region of the foot support member.

4. The foot support member according to claim 1, wherein the first flexible support member includes a first side member that extends to a first height above the first plural wave crests and a second side member that extends to a second height above the first plural wave crests and is located opposite from the first side member, and wherein the plantar support component is positioned between the first side member and the second side member.

5. The foot support member according to claim 4, further comprising a tensioning element or spring component extending between the first side member and the second side member.

6. The foot support member according to claim 1, further comprising:

a third flexible support member disposed adjacent the second surface of the plantar support component, wherein the third flexible support member includes a third wave shaped portion, wherein the third wave shaped portion is oriented such that third plural wave crests extend toward the first surface of the plantar support component and third plural wave troughs extend away from the first surface of the plantar support component, wherein the third wave shaped portion of the third flexible support member is formed as a third rigid plate made from said rigid but flexible material or another rigid but flexible material capable of flexing under weight of the wearer, and wherein flexing of the third rigid plate under weight of the wearer induces at least one third reaction selected from the group consisting of: (a) causes at least a portion of the third rigid plate to become flatter and (b) causes at least a portion of the third rigid plate to compress together.

7. The foot support member according to claim 6, wherein the first flexible support member: (a) is located in a heel region of the foot support member and (b) extends from a lateral side to a medial side of the plantar support component, wherein the second flexible support member: (a) is located in the heel region of the foot support member forward of the first flexible support member and (b) extends from the lateral side to the medial side of the plantar support component, and wherein the third flexible support member: (a) is located in the heel region of the foot support member forward of the second flexible support member and (b) extends from the lateral side to the medial side of the plantar support component.

8. The foot support member according to claim 6, wherein the third flexible support member is joined together as part of the unitary, one piece construction with the first flexible support member and the second flexible support member by a second link extending between the adjacent wave crest peak of the second plural wave crests of the second flexible support member including the first link and an adjacent wave crest peak of the third plural wave crests of the third flexible support member.

9. The foot support member according to claim 1, wherein the first flexible support member: (a) is located in a heel region of the foot support member and (b) extends from a lateral side to a medial side of the plantar support component, and wherein the second flexible support member: (a) is located in the heel region of the foot support member forward of the first flexible support member and (b) extends from the lateral side to the medial side of the plantar support component.

10. The foot support member according to claim 1, wherein the first flexible support member extends from a lateral side to a medial side of the plantar support component, and wherein the second flexible support member extends from the lateral side to the medial side of the plantar support component.

11. A method of manufacturing a foot support member, comprising:

providing a plantar support component for supporting at least a portion of a plantar surface of a wearer's foot, wherein the plantar support component includes a first surface and a second surface opposite the first surface;

providing a first flexible support member disposed adjacent the second surface of the plantar support component, wherein the first flexible support member includes a first wave shaped portion, wherein the first wave shaped portion is oriented such that first plural wave crests extend toward the first surface of the plantar support component and first plural wave troughs extend away from the first surface of the plantar support component, wherein the first wave shaped portion is formed as a first rigid plate made from a rigid but flexible material capable of flexing under weight of the wearer, and wherein flexing of the first rigid plate under weight of the wearer induces at least one first reaction selected from the group consisting of: (a) causes at least a portion of the first rigid plate to become flatter and (b) causes at least a portion of the first rigid plate to compress together;

providing a second flexible support member disposed adjacent the second surface of the plantar support component, wherein the second flexible support member includes a second wave shaped portion, wherein the second wave shaped portion is oriented such that second plural wave crests extend toward the first surface of the plantar support component and second plural wave troughs extend away from the first surface of the plantar support component, wherein the second wave shaped portion is formed as a second rigid plate made from said rigid but flexible material or another rigid but flexible material capable of flexing under weight of the wearer, wherein flexing of the second rigid plate under weight of the wearer induces at least one second reaction selected from the group consisting of: (a) causes at least a portion of the second rigid plate to become flatter and (b) causes at least a portion of the second rigid plate to compress together; and wherein the first flexible support member and the second flexible support member are joined together as a unitary, one piece construction by a first link extending between a wave crest peak of the first plural wave crests of the first flexible support member and an adjacent wave crest peak of the second plural wave crests of the second flexible support member.

12. The method according to claim 11, further comprising:

providing a third flexible support member disposed adjacent the second surface of the plantar support component, wherein the third flexible support member includes a third wave shaped portion, wherein the third wave shaped portion is oriented such that third plural wave crests extend toward the first surface of the plantar support component and third plural wave troughs extend away from the first surface of the plantar support component, wherein the third wave shaped portion of the third flexible support member is formed as a third rigid plate made from said rigid but flexible material or another rigid but flexible material capable of flexing under weight of the wearer, and wherein flexing of the third rigid plate under weight of the wearer induces at least one third reaction selected from the group consisting of: (a) causes at least a portion of the third rigid plate to become flatter and (b) causes at least a portion of the third rigid plate to compress together.

13. The method according to claim 12, wherein the third flexible support member is joined together as part of the unitary, one piece construction with the first flexible support member and the second flexible support member by a second link extending between the adjacent wave crest peak of the second plural wave crests of the second flexible support member including the first link and an adjacent wave crest peak of the third plural wave crests of the third flexible support member.

14. The method according to claim 11, wherein the first flexible support member includes a first side member that extends to a first height above the first plural wave crests and a second side member that extends to a second height above the first plural wave crests and is located opposite from the first side member, and wherein the plantar support component is positioned between the first side member and the second side member.

15. A foot support member, comprising:

a heel support component for supporting a heel portion of a wearer's foot, wherein the heel support component includes a first surface and a second surface opposite the first surface;

a first flexible support member disposed adjacent the second surface of the heel support component, wherein the first flexible support member includes a first wave shaped portion oriented such that first plural wave crests extend toward the first surface of the heel support component and first plural wave troughs extend away from the first surface of the heel support component, and wherein the first wave shaped portion is formed as a first rigid plate made from a rigid but flexible material capable of flexing under weight of the wearer;

a second flexible support member disposed adjacent the second surface of the heel support component, wherein the second flexible support member includes a second wave shaped portion oriented such that second plural wave crests extend toward the first surface of the heel support component and second plural wave troughs extend away from the first surface of the heel support component, wherein the second wave shaped portion is formed as a second rigid plate made from said rigid but flexible material or another rigid but flexible material capable of flexing under weight of the wearer, and wherein the first flexible support member and the second flexible support member are joined together as a unitary, one piece construction by a first link extending between a wave crest peak of the first plural wave crests of the first flexible support member and an adjacent wave crest peak of the second plural wave crests of the second flexible support member.

16. The foot support member according to claim 15, further comprising:

a third flexible support member disposed adjacent the second surface of the heel support component, wherein the third flexible support member includes a third wave shaped portion oriented such that third plural wave crests extend toward the first surface of the heel support component and third plural wave troughs extend away from the first surface of the heel support component, and wherein the third wave shaped portion is formed as a third rigid plate made from said rigid but flexible material or another rigid but flexible material capable of flexing under weight of the wearer.

17. The foot support member according to claim 16, wherein the third flexible support member is joined together as part of the unitary, one piece construction with the first flexible support member and the second flexible support member by a second link extending between the adjacent wave crest peak of the second plural wave crests of the second flexible support member including the first link and an adjacent wave crest peak of the third plural wave crests of the third flexible support member.

18. The foot support member according to claim 15, wherein the first flexible support member includes a first side member that extends to a first heigt above the first plural wave crests and a second side member that extends to a second height above the first plural wave crests and is located opposite from the first side member, and wherein the heel support component is positioned between the first side member and the second side member.

19. The foot support member according to claim 18, further comprising a tensioning element fixed to and extending between the first side member and the second side member.

20. The foot support member according to claim 15, wherein the heel support component includes a raised sidewall extending above the first surface, wherein the raised sidewall extends continuously around a rear heel area and forms a medial sidewall and a lateral sidewall of the heel support component.

* * * * *